US006462715B1

(12) United States Patent
Ehrenberg et al.

(10) Patent No.: US 6,462,715 B1
(45) Date of Patent: Oct. 8, 2002

(54) QUICK DISCONNECT ASSEMBLY

(75) Inventors: Robert G. Ehrenberg, Torrance, CA (US); Michael Sorensen, Ashland, OR (US)

(73) Assignee: NeTune Communications, Inc., Culver City, CA (US)

( * ) Notice: Subject to any disclaimer, the term of this patent is extended or adjusted under 35 U.S.C. 154(b) by 0 days.

(21) Appl. No.: 09/813,364

(22) Filed: Mar. 20, 2001

(51) Int. Cl.[7] ..... H01Q 13/10
(52) U.S. Cl. ..... 343/771; 343/772; 333/254
(58) Field of Search ..... 343/771, 772, 343/786; 333/254, 255; 285/368, 412; H01Q 13/10

(56) References Cited

U.S. PATENT DOCUMENTS

| | | | | | |
|---|---|---|---|---|---|
| 3,893,122 | A | * | 7/1975 | Feeney | 343/705 |
| 4,514,708 | A | * | 4/1985 | Ludtke | 333/255 |
| 4,801,945 | A | * | 1/1989 | Luly | 343/786 |
| 5,726,667 | A | * | 3/1998 | Tamura | 343/786 |
| 5,943,024 | A | * | 8/1999 | Lydon | 343/781 R |
| 6,043,789 | A | * | 3/2000 | Suzuki et al. | 343/786 |
| 6,140,893 | A | * | 10/2000 | Sciarrino | 333/254 |

* cited by examiner

*Primary Examiner*—Tho G. Phan

(74) *Attorney, Agent, or Firm*—Brown Raysman Millstein Felder & Steiner LLP

(57) ABSTRACT

A quick disconnect assembly 200 simply and quickly connects two components to one another with the high degree of accuracy while eliminating small, losable parts. The quick disconnect assembly includes a receiver 202 and a fork 206. The receiver is attached to a first fitting 204 on a first component 132. A fork end brace 205 extends out from the receiver to provide an attachment flange for the fork. The second component 137 has a second fitting 208 that is correspondingly shaped to mate against the first fitting and to house within the receiver. The fork is attached via a lanyard to the second fitting. The fork includes a securement knob 210 having threadings 207 that projects through the base of the fork. Rotation of the knob advances or retracts the threadings. The legs of the fork contain protrusions 212 and 214 are correspondingly shaped to mate with depressions 216 and 218 in the receiver. In order to connect the second component to the first component, the second fitting of the second component is inserted into the receiver and against the first fitting of the first component. The fork is then lowered over the receiver until the ends of the fork seat under the fork end brace. The fork is rotated about the end brace until the fork leg protrusions seat within the receiver depressions, and the fork is substantially flush against the receiver. The securement knob is then hand tightened, causing the threadings to secure into a correspondingly threaded aperture in the receiver to complete the installation.

20 Claims, 27 Drawing Sheets

50
52
46
54
48
44
40
42
43
45

QUICK DISCONNECT ASSEMBLY

FIELD OF THE INVENTION

This invention relates generally to an antenna assembly and, more particularly, to a collapsible, steerable antenna assembly configured for rapid deployment.

BACKGROUND OF THE INVENTION

Traditionally, to receive an adequate signal from a communication satellite, an antenna had to be securely fitted to a rigid mount which was adjustable in both azimuth and elevation. Later, antennas began being mounted on moving vehicles. These antenna systems were required to be adjustable in elevation sufficiently to suit the latitude of the vehicle. In addition, portable antenna systems also began to develop. These portable systems were also required to be adjustable in elevation sufficient to suit the latitude of the ground at which they were located.

The use of portable antenna systems and other electronic equipment in the field today often requires the positioning of an antenna of substantial size, in order to prevent terrestrial interference and interference from other satellites with signal beings radiated or received by the antenna. In addition, the antenna and its support should be sufficiently compact in the stowed position, so as to not interfere with mobility of the antenna in the field.

Portable antenna systems of the general type mentioned above have been built in the past, but suffer from several disadvantages. These include excessive assembly time, a large number of separate pieces, complex assembly procedures which lead to a loss of parts and unreliability, difficulty of assembly, and the requirement of multiple operators to assemble and disassemble the system.

In addition, these systems have been designed with the primary goal of breaking the unit down into multiple lightweight shipping containers that meet the maximum standards for lower lobe airline shipping. This increases the complexity and lengthens the assembly time of the antenna.

Further, past systems have proved inadequate in their ability to minimize distortion in the antenna dish of the system, due to either assembly technique or parametric distortion under the weight of the dish and other system components.

It is desirable for antenna system components to be as adjustable as possible for positioning and alignment efficiency. There is a continuing need for an antenna system that is highly accurate, yet has high modularity and portability, while remaining simple to assembly.

Accordingly, those skilled in the art have long recognized the need for a collapsible, steerable antenna assembly configured for rapid deployment. The present invention clearly fulfills these and other needs.

SUMMARY OF THE INVENTION

Briefly, and in general terms, the present invention resolves the above and other problems by providing a quick disconnect assembly for accurate connection and disconnection of components. The quick disconnect assembly includes a first component having a first fitting, a second component having a second fitting, a receiver, and a fork. The second fitting is configured to seat against and be connected to the first fitting through the use of the quick disconnect assembly. The receiver is secured to the first fitting. Additionally, the receiver is configured to correspondingly house the second fitting upon selective insertion of the second fitting into the receiver. The receiver further includes a contact face, a fork end brace, and a threaded aperture. The fork further includes a contact face, a base portion, and two legs with leg ends. The base portion includes a securement knob with threadings. Rotation of the securement knob advances or retracts the threadings. Insertion of the ends of the legs under the fork end brace of the receiver, and rotation of the fork legs about the fork end brace causes the contact face of the fork to seat against the contact face of the receiver. Additionally, tightening the securement knob causes the threadings of the fork to secure in the threaded aperture of the receiver, thereby securing the fork against the receiver.

In a preferred aspect of the present invention, the legs of the fork are shaped and sized to seat over the second component. Preferably, securing the fork to the receiver affixes the second fitting against the first fitting and within the receiver. The receiver includes a plurality of depressions, and the fork legs include a plurality of protrusions that are positioned and configured to correspondingly mate with the depressions in the receiver. In this manner, insertion of the ends of the legs under the fork end brace of the receiver and rotation of the fork legs about the fork end brace causes the protrusions on the fork legs to seat into the depressions in the receiver when the fork is secured against the receiver thereby causing evenly distributed pressure between the second and the first fitting thus securing the second and first fittings together.

In another preferred embodiment quick disconnect assembly of the present invention, the receiver includes a plurality of protrusions, and the fork legs include a plurality of depressions that are positioned and configured to correspondingly mate with the protrusions on the receiver. In this manner, insertion of the ends of the legs under the fork end brace of the receiver and rotation of the fork legs about the fork end brace causes the depressions in the fork legs to seat onto the protrusions on the receiver when the fork is secured against the receiver.

In a preferred aspect of the present invention, the threadings of the securement knob penetrate through the base portion of the fork. The quick disconnect assembly secures the first component to the second component without the use of loose parts or tools. The fork is operatively connected to the first component to prevent part loss. In one preferred embodiment of the quick disconnect assembly of the present invention, the first component is an amplifier, the first fitting is a mating wave guide fitting on the amplifier, the second component is a flexible wave guide, and the second fitting is a wave guide end fitting of the flexible wave guide. In this embodiment, the quick disconnect assembly is used to secure the wave guide to the amplifier in an antenna system.

In one preferred embodiment of the present invention, the dish assembly, back frame assembly, rotary steering assembly, and collapsible mount assembly are deployable by a single person. Preferably, the steerable antenna assembly is collapsible, rapidly deployable, has very few parts, and is inexpensive compared to other types of known antenna systems.

Other features and advantages of the present invention will become apparent from the following detailed description, taken in conjunction with the accompanying drawings, which illustrate by way of example, the features of the present invention.

DETAILED DESCRIPTION OF THE PREFERRED EMBODIMENTS

Figure 1:
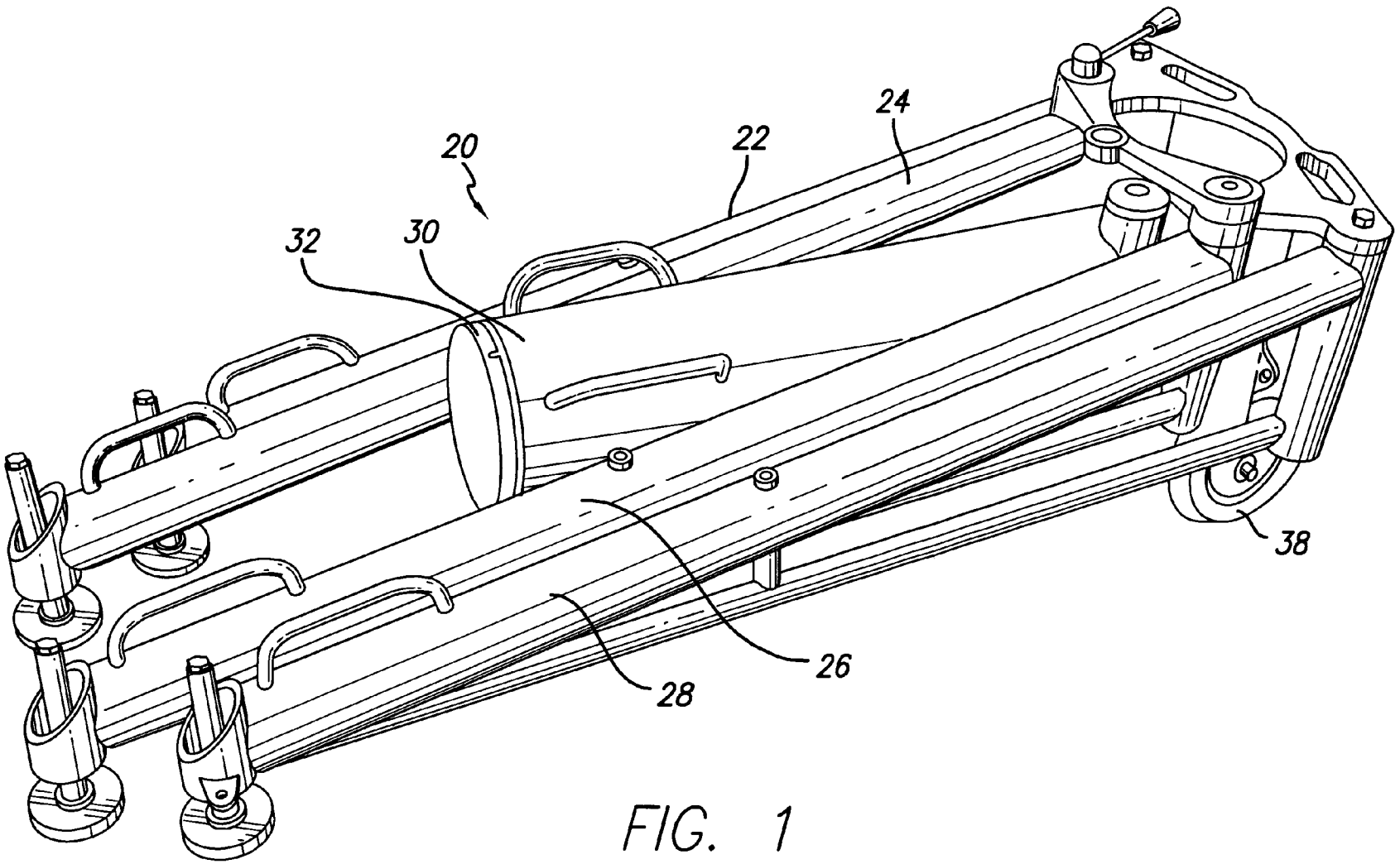
FIG. 1 illustrates a perspective view of a preferred embodiment quad pod assembly of the present invention in a collapsed state for transportation with the central shaft in a folded horizontal position, the extendable telescopic column in a stored retracted position, and the plurality of ground-engaging support legs in a folded position.
Figure 2:
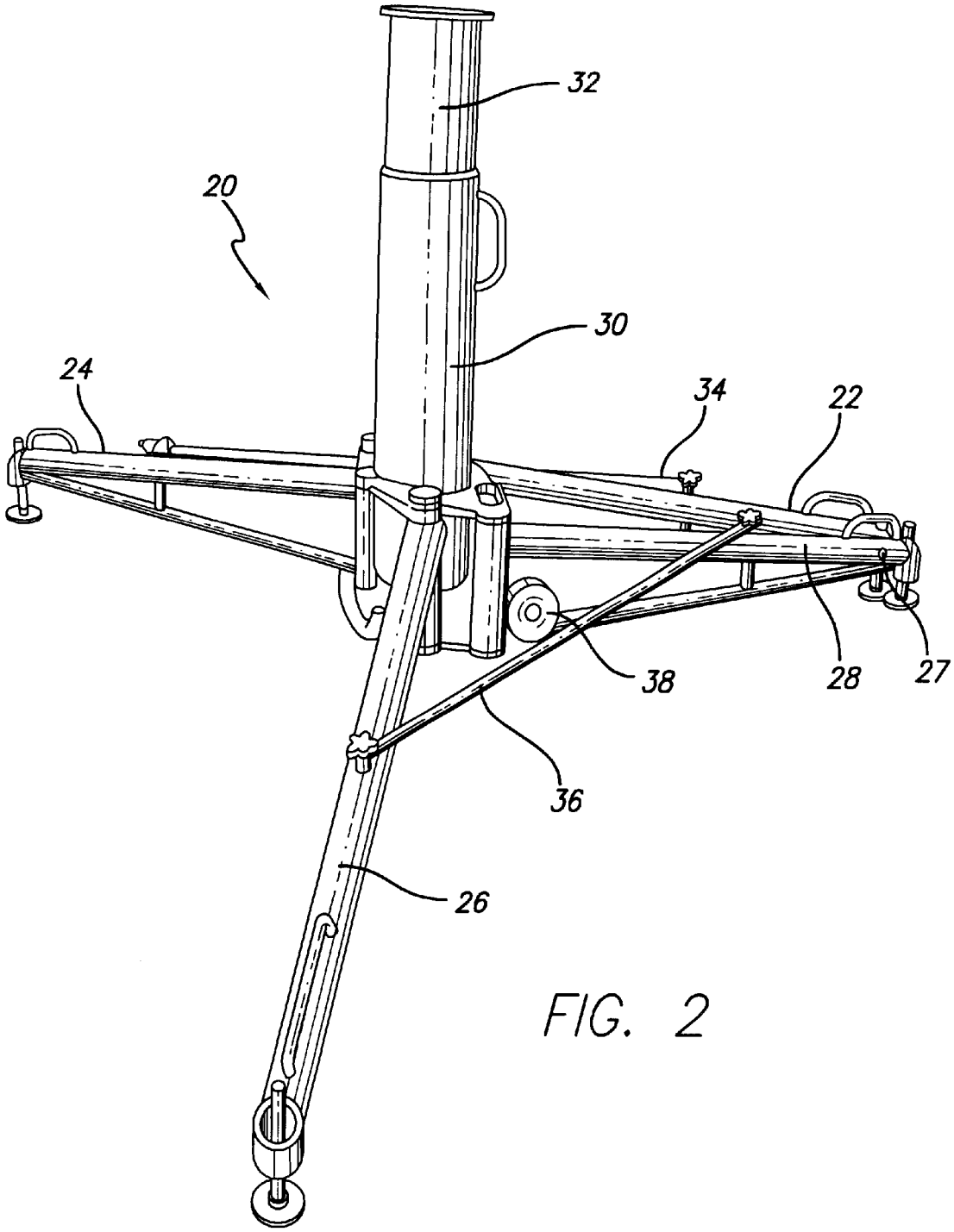
FIG. 2 illustrates a perspective view of the quad pod assembly of FIG. 1 in a deployed state for operation with the central shaft in an unfolded vertical position, the extendable telescopic column in an operational extended position, and the plurality of ground-engaging support legs in a deployed position.

A preferred embodiment steerable antenna system, constructed in accordance with the present invention, provides a rapidly deployable, collapsible antenna system that is inexpensive compared to equivalent antenna systems, and can be deployed by as few as a single person. The steerable antenna system is also easily aligned and calibrated, allowing for superior accuracy during mobile deployment of the system. Referring now to the drawings, wherein like reference numerals denote like or corresponding parts throughout the drawings, and more particularly to FIGS. 1–14, where there is shown a preferred antenna system 10.

Briefly stated, a preferred embodiment of the present invention provides a collapsible, steerable antenna system 10 that is configured for rapid deployment, and is highly accurate and sophisticated, yet easy to assemble. The antenna system 10 includes a pod mount assembly 20 (shown in FIGS. 1–4); a steering head controller assembly 40 (shown in FIGS. 3–6); a back frame 60 (shown in FIGS. 7–9); a dish assembly 100 (shown in FIGS. 7–8A, and 11); a feed leg assembly 120 (shown in FIGS. 11, 12 and 12A); a horn mount assembly 160 (shown in FIGS. 13 and 14); and a horn assembly 180 (shown in FIGS. 13 and 14).

As shown in FIGS. 1–4, the pod mount assembly 20 includes a plurality of ground engaging pod legs 22, 24, 26, 28, a central column 30, and a telescopic shaft 32 which lifts and supports the controller assembly 40. The controller assembly 40 selectively engages with the back frame 60 and aligns the dish assembly 100 via the back frame. The back frame 60 engages and supports the dish assembly 100 to help minimize parametric distortion of the dish assembly. The dish assembly 100 includes a plurality of wedge-shaped pieces 102, 104, 106, and 108, which connect to form the dish assembly. The feed leg assembly 120 includes a main feed leg 122 and side feed legs 140 and 142. The horn mount assembly 160 connects the horn assembly 180 to the main feed leg. The horn assembly 180 directs the transmission signal towards the dish assembly 100 when transmitting a signal.

Figure 7:
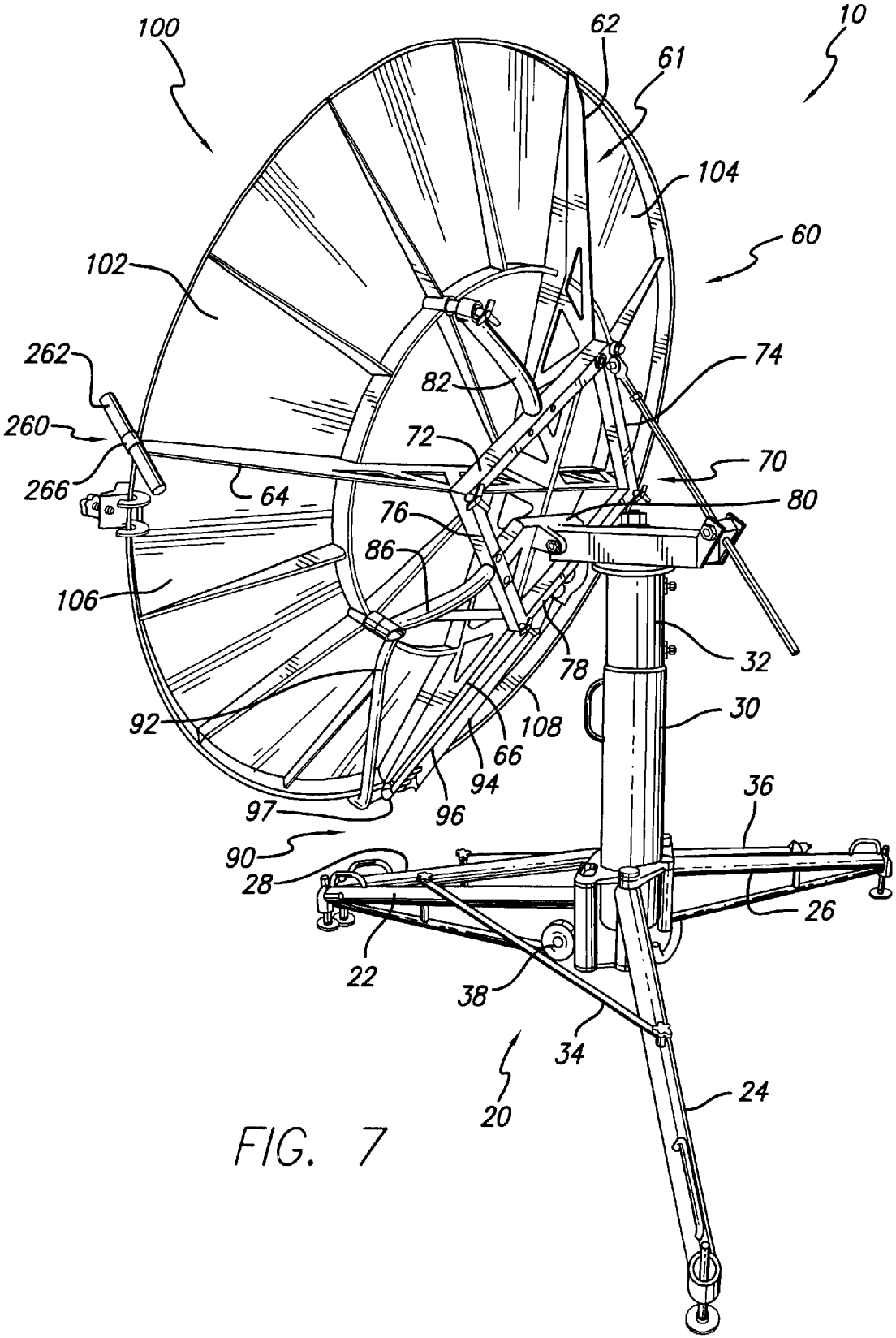
FIG. 7 illustrates a perspective view of a fully deployed antenna system with only a static controller head, wherein the antenna system utilizes a preferred embodiment back frame assembly of the present invention that includes a center frame, a collapsible template assembly, and a feed leg mount to support the weight of a horn assembly, main feed leg, and amplifier.

Preferably, the antenna system 10 also includes a horn-mounted polarization drive assembly 190 (shown in FIGS. 15–17), a wave-guide quick disconnect assembly 200 (shown in FIGS. 18–20), an alignment jig 220 (shown in FIGS. 21–23), a laser alignment device 250 (shown in FIGS. 24–25), and a transmission field sighting device 260 (shown in FIG. 7). The horn mounted polarization drive assembly 190 attaches to the horn mount assembly 160 and is used for polarization alignment of the horn mount assembly. The wave-guide quick disconnect assembly 200 is used to release the flexible wave guide 137 from the amplifier 132. The alignment jig 220 includes a plurality of alignment arms 228, 230, and 232 and is used to facilitate proper positioning of the horn assembly 180. The laser alignment device 250 selectively mounts on the horn mount assembly 160 for aligning the horn mount assembly with respect to the dish assembly 100. The transmission field sighting device 260 selectively attaches to the back frame 60 and is used to ensure that the transmission field is free from obstructions.

Referring again to FIGS. 1–4, there is shown one preferred embodiment of the present invention which includes a pod mount assembly 20. Preferably, the pod mount assembly 20 is configured in a folding quad pod design with four ground-engaging legs 22, 24, 26, 28, and a rotatable central column 30. The four ground-engaging legs 22, 24, 26, and 28 rotatably connect to the base of the central column 30. The central column 30 is preferably cylindrical in shape and contains a telescoping central shaft 32. A first connection link 34 connects the first and second ground-engaging legs 22 and 24, while a second connection length 36 connects the third and fourth ground-engaging legs 26 and 28. Wheels 38 are also connected to the base of the central column 30.

The pod mount assembly 20 acts as the mounting base for the rest of the antenna assembly 10. The unique folding and collapsible design of the pod mount assembly 20 creates a small form factor when in its folded state, emphasizing its high mobility and ease of deployment. When in the folded state, all four ground-engaging legs 22, 24, 26, and 28, and the central column 30 lie side-by-side, substantially in parallel to each other, and can be easily moved by a single person. Specifically, the pod mount assembly 20 is moved by lifting one end of the pod mount assembly and rolling the collapsed assembly on its wheels 38 like a wheelbarrow.

To deploy the pod mount assembly 20, the ends of the first and fourth ground-engaging legs 22 and 28 are rotated outward and away from the central column 30 in symmetrical, semi-circular paths until the ends of the first and fourth legs 22 and 28 meet at the opposite side of the pod mount assembly. The second and third ground-engaging legs 24 and 26 are also rotated outward in an arcuate path to form a substantially tripod-shaped configuration. (The four legs produce a tripod shape because the first and fourth ground-engaging legs 22 and 28 are placed directly next to one another and pinned together with pin 27, thereby resembling a single leg.) As previously mentioned, the first connection link 34 connects the first and second ground-engaging legs 22 and 24, and the second connection link 36 connects the third and fourth ground engaging legs 26 and 28, in order to add further stability to the deployed base structure of the mount assembly 20. In other embodiments, in accordance with the present invention, the pod mount can be used as a quadrapod with the addition of two other connecting links. In still other embodiments, a different number of ground engaging legs may be utilized by the mount assembly 20 in accordance with the desired design parameters.

At this point, the central column 30 can then be rotated from a horizontal position into a vertical position. The telescopic shaft 32 can be extended upward from its retracted position within the central column 30 into its extended position thereabove. In one embodiment of the present invention, the pod mount assembly 20 further includes a hydraulic hand pump and cylinder (not shown) to assist with the rotation of the central column 30 and the extension of the telescopic shaft 32. Preferably, the hydraulic fluid is housed within one or more of the ground engaging legs. Further, one embodiment the hydraulic system includes a switch that alternates the hydraulic forces between (1) rotating the central column 30 from a horizontal position into a vertical position; (2) extending the telescopic shaft 32 from its retracted position within the central column 30 into its extended position; and (3) retracting the telescopic shaft 32 from its extended position into its retracted position within the central column 30.

Figure 3:
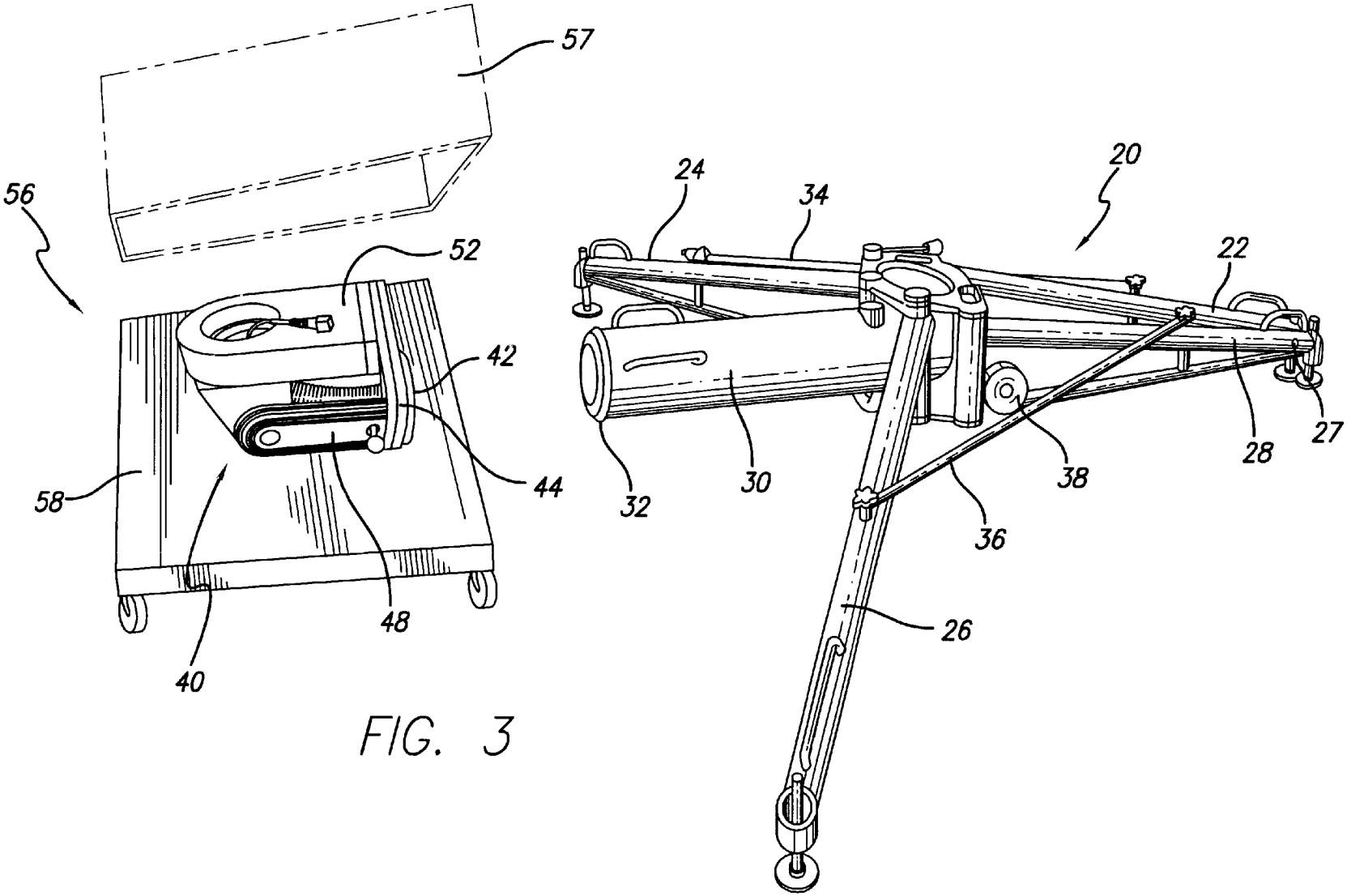
FIG. 3 illustrates a perspective view of a preferred embodiment quad pod assembly and a steering controller assembly of the present invention, where the quad pod assembly has its central shaft in a folded horizontal position, the extendable telescopic column in a stored retracted position, and the plurality of ground-engaging support legs in a deployed position, and wherein the steering controller assembly is positioned on the wheeled base of its shipping case so as to attach to the extendable telescopic column of the quad pod assembly without requiring manual lifting of the steering controller assembly.
Figure 4:
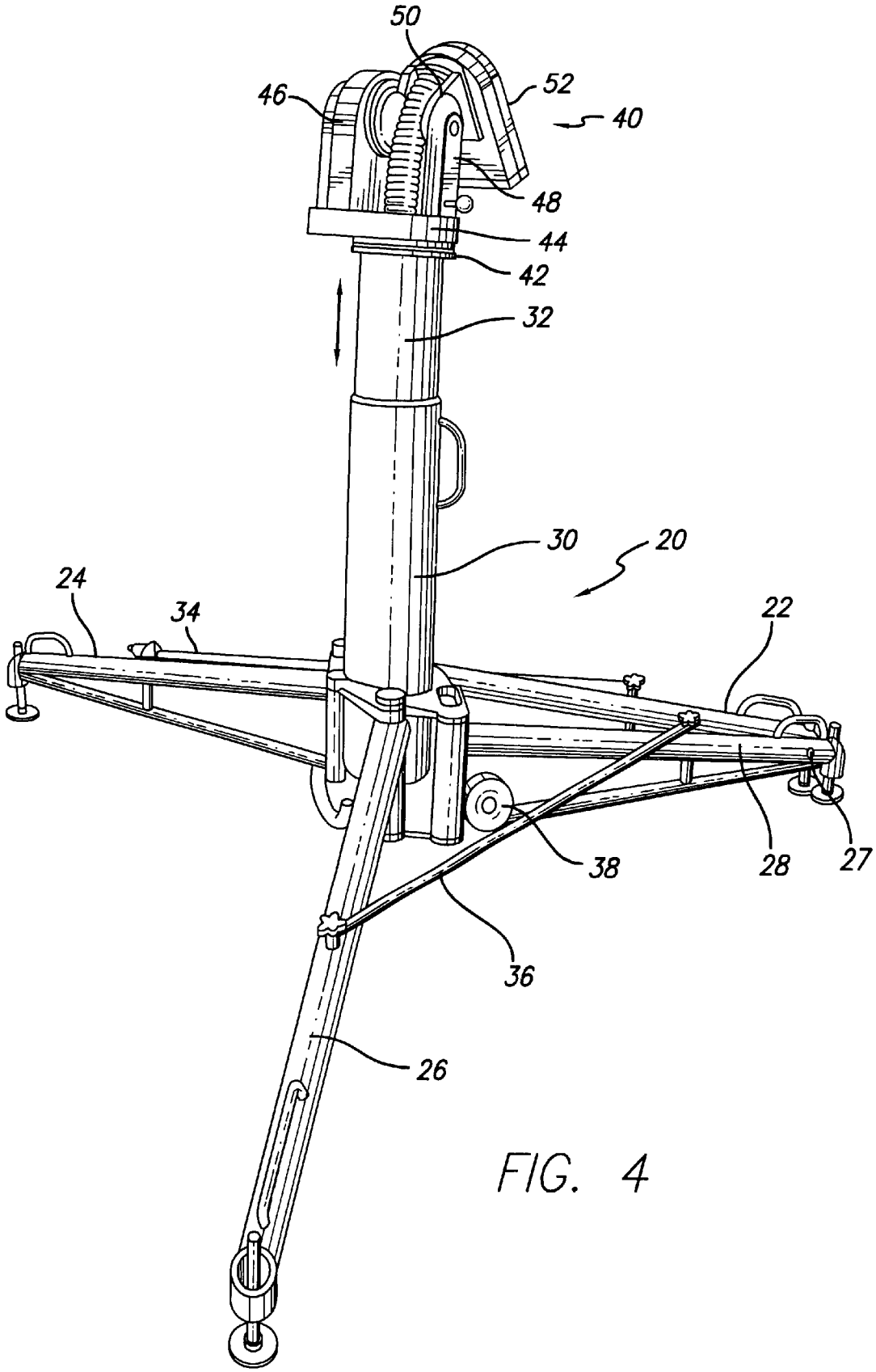
FIG. 4 illustrates a perspective view of the quad pod assembly and steering controller assembly of FIG. 3 in a deployed state for operation with the central shaft in an unfolded vertical position, the extendable telescopic column in an operational extended position, the plurality of ground-engaging support legs in a deployed position, and the steering controller assembly mounted on top of the telescopic column.

Referring now to FIG. 4, the pod mount assembly 20 and the steering controller 40 are presumed to be fully assembled, and the end of the telescopic shaft 32 of the pod mount assembly 20 directly supports the controller assembly 40. Since controller assemblies are typically quite heavy (weighing a few hundred pounds or more), previously-used antenna systems have had difficulty lifting and positioning a controller assembly onto the upright shaft of an antenna base. However, as shown in FIG. 3, in a preferred embodiment of the present invention, the controller assembly 40 is positioned in its shipping case 56, so that it can be directly mounted on the end of the telescopic shaft 32 when the pod mount assembly 20 is still in a horizontal and collapsed folded state.

The pod mount assembly 20 then performs two lifting functions. First, the telescopic shaft 32 and central column 30 of the pod mount assembly 20 rotate the controller assembly 40 upward directly from its shipping case 56 into a vertical position atop the quad pod telescopic shaft 32. Secondly, the telescopic shaft 32 extends from within the central column 30 raising the controller assembly 40 from its assembly position into its elevated operating position. Preferably, the hydraulic pump is strong enough so that the back frame assembly 60 and possibly even the antenna dish assembly 100 can be mounted to the controller assembly 40 during varying stages of the upward rotation of the central column 30 of the pod mount assembly 20. This technique facilitates ease of assembling the antenna system by a single individual by reducing the amount of manual lifting required of the back frame assembly 60 and antenna dish assembly 100.

This design allows a single individual to be able to quickly and easily assemble the pod mount assembly 20 and position the controller assembly 40 (which would otherwise be too difficult for a single person to maneuver) atop the pod mount assembly 20. Sophisticated antenna systems typically require significant amounts of time and are difficult to assemble due to their complexity, as well as requiring numerous individuals to lift and manipulate such heavy components. As previously mentioned, in a preferred embodiment the pod mount assembly 20 is hydraulically powered; however, in other embodiments of the present invention electrical, pneumatic, or other known powering means may be utilized. Further, the pod mount assembly 20 of the present invention also allows for multiple antenna sizes to be utilized due to the flexibility of the extension mechanism. Those skilled in the art will appreciate that the pod mount assembly 20 described above can be used either in conjunction with or independently of the other components of the antenna assembly 10 described herein.

Referring now to FIGS. 3–6, the controller assembly 40 is shown in greater detail. When unassembled, the controller assembly 40 is packaged in a shipping case 56 that preferably includes a wheeled base 58. Having wheels on the shipping case 56 allows the heavy controller assembly 40 to be more easily moved during the assembly of the antenna system 10. As previously mentioned, the controller assembly 40 is positioned within the shipping case 56 such that it is at the proper height and orientation to roll directly up to the telescopic shaft 32 of the collapsed pod mount assembly 20 to be secured thereto. In this regard, the shipping case 56 preferably has an easily removable top and wall section 57 which allows the controller assembly 40 to be juxtapositioned against the end of the telescopic shaft 32 while still on the rolling base of the shipping case 56.

The controller assembly 40 utilizes a triple tombstone controller configuration for the steering of the dish assembly 100, with each tombstone controller allowing for independent rotation around a respective axis. Specifically, a preferred embodiment controller assembly 40 includes a pod mount attachment 42 for connecting to the telescopic shaft 32 of the pod mount assembly 20; a first tombstone controller 44 that rotates in the horizontal plane; a second tombstone controller 46 that rotates in the vertical plane; a vertical support 48; an axle bracket 50; a third tombstone controller 52 that rotates about the transmission beam axis (Z-axis); and a back frame attachment for connecting to the back frame 60. In one preferred embodiment shown in FIG. 6, the pod mount attachment 42, which connects to the telescopic shaft 32 of the pod mount assembly 20, includes a plurality of rotatable clamps 43 that are configured with apertures that are corresponding shaped to mount on horizontally, outwardly facing protrusions 45 extending from the top of the telescopic shaft 32. By simply rotating the clamps 43, the controller assembly 40 can be easily secured and unsecured to the pod mount assembly 20. Preferably, each clamp 43 includes a screw for locking the clamps over the protrusions 45.

The controller assembly 40 allows for maximum adjustability since the first tombstone controller 44 rotates about a first axis, the second tombstone controller 46 rotates about a second axis, and the third tombstone controller 52 rotates about a third axis. In this manner, the controller assembly 40 has the steering capability to control articulation in azimuth, elevation, and polarization. The ability of the controller assembly 40 to control the polarization of the entire dish, in addition to the azimuth and elevation, allows the controller assembly to effectively utilize different shaped dishes; that is, dishes with non-circular beam apertures (by way of example only, square, elliptical, parallel piped, and the like). The controller assembly 40 is driven by standard software for antenna control systems and feed signal searching techniques.

Figure 5:
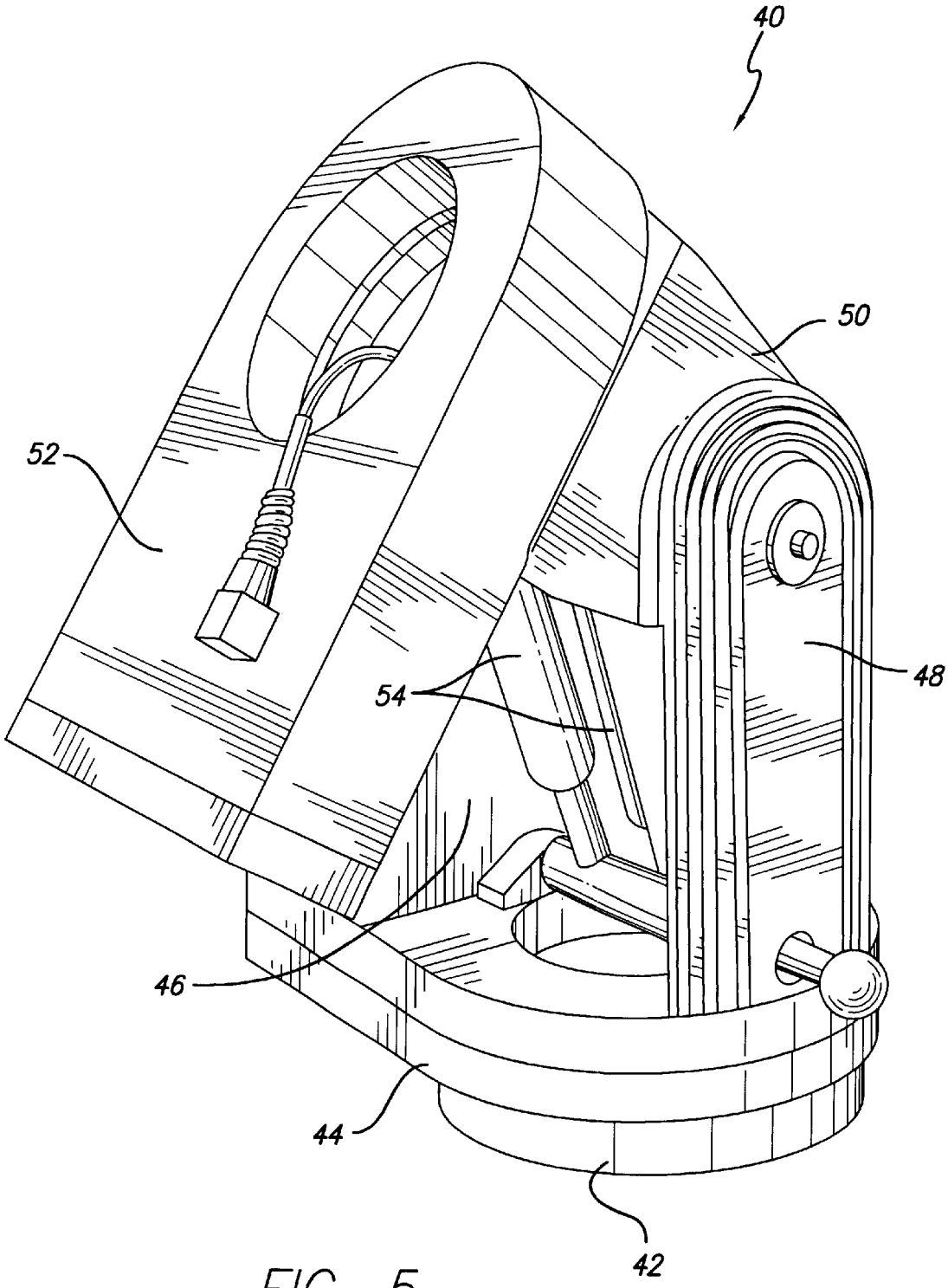
FIG. 5 illustrates a front isolation view of a preferred embodiment steering controller assembly of the present invention utilizing a triple tombstone controller configuration.
Figure 6:
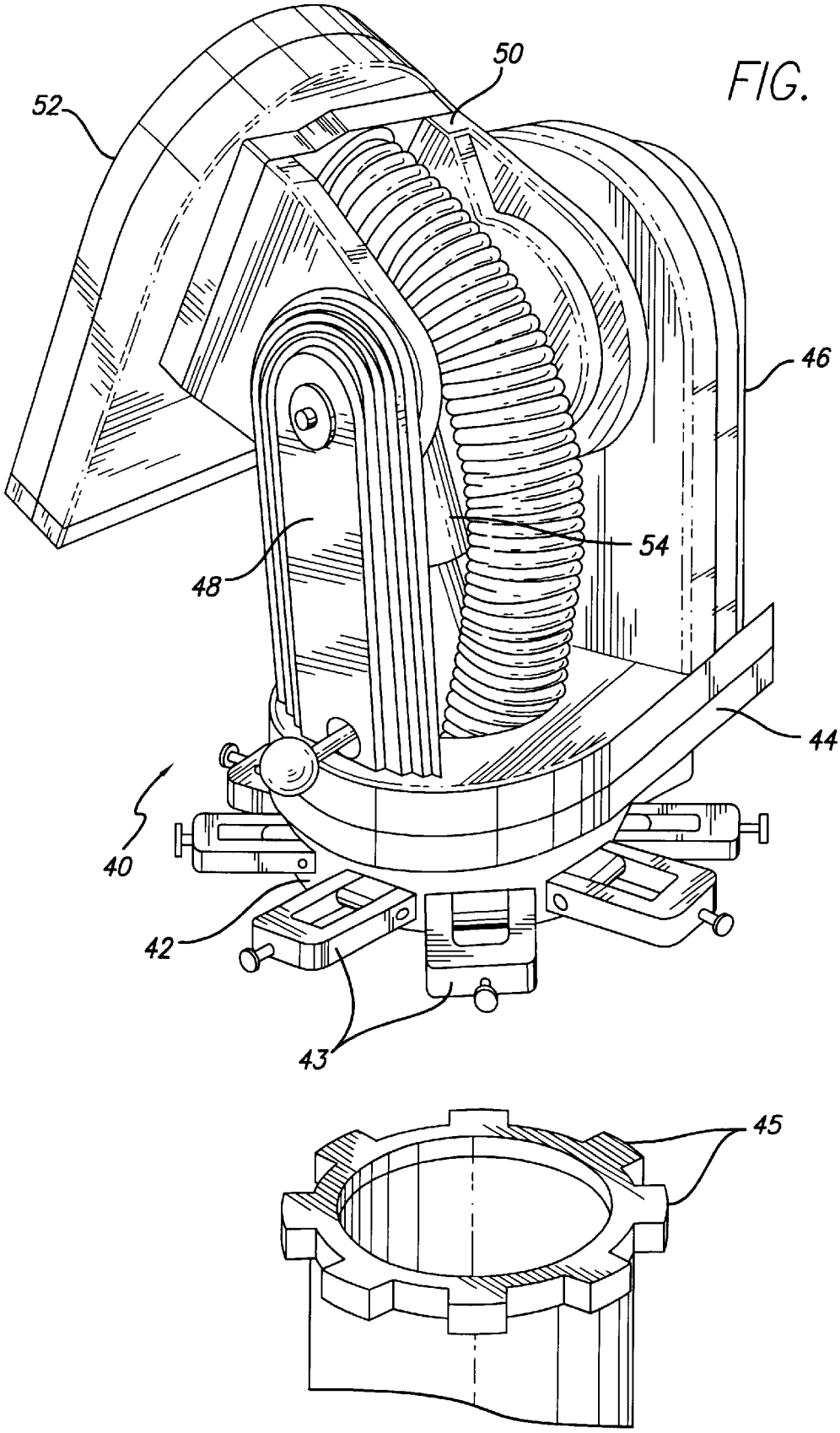
FIG. 6 illustrates a rear isolation view of the steering controller assembly of FIG. 5, in an embodiment where the pod mount attachment of the steering controller assembly includes rotatable clamps that mount onto protrusions that extend outward from the telescopic shaft of the quad pod assembly.

As shown in FIGS. 5 and 6, the first tombstone controller 44 is positioned horizontally to allow the second tombstone controller 46 to be positioned vertically on the base portion of the first tombstone. The vertical support 48 is positioned in an upright orientation at the other end of the tombstone controller 44, opposite the second tombstone controller 46. The axle bracket 50 is supported by and rotates about the second axis which runs between the second tombstone controller 46 and the vertical support 48. The axle bracket 50 also attaches to the third tombstone controller 52 to facilitate rotation about the transmission beam axis, thereby connecting the major components of the steering head controller assembly 40.

In a preferred embodiment controller assembly 40, the direction of polarity is in the plane of the third tombstone 52. The direction of polarity is also at right angles to the transmission angle. The controller assembly 40 employs existing, low-cost rotary motor controllers to facilitate the steering of the dish assembly 100. The design of the controller assembly 40 allows 360 degree articulation in both azimuth and antenna polarization, and allows greater than 90 degree movement in elevation. The controller assembly 40 preferably uses a gas spring counterbalance 54 to offset the weight of the dish assembly 100 and feed leg assembly 120 of the fully-assembled antenna assembly 10. This reduces the power requirement for positioning the dish assembly 100 and allows for a larger load capacity.

The coordinates required for steering the dish assembly 100 can be calculated from an inexpensive, commercial, off-the-shelf, GPS location finder, and from an inexpensive, commercial, off-the-shelf, flux gate compass. The controller assembly 40 is weatherproof, but cannot withstand full immersion in water. Preferably, the present invention includes a flux gate compass that has a level compensator in order to correct for compass inaccuracies that can be incurred while leveling the quad pod mount assembly 20. This level compensator will typically work for tilting errors of up to 20 degrees. Preferably, the present invention includes an electronic level meter to adjust the elevation of the dish. The motion of the dish assembly 100 in azimuth is limited only by the twist incurred from the co-axial connections used by the satellite transceiver. The motion of the dish assembly 100 in polarization is limited only by the twist incurred in the polarization tombstone controller's own control cable and power cable. Those skilled in the art will appreciate that the controller assembly 40 described above can be used either in conjunction with or independently of the other components of the antenna assembly 10 as described herein.

Figure 8:
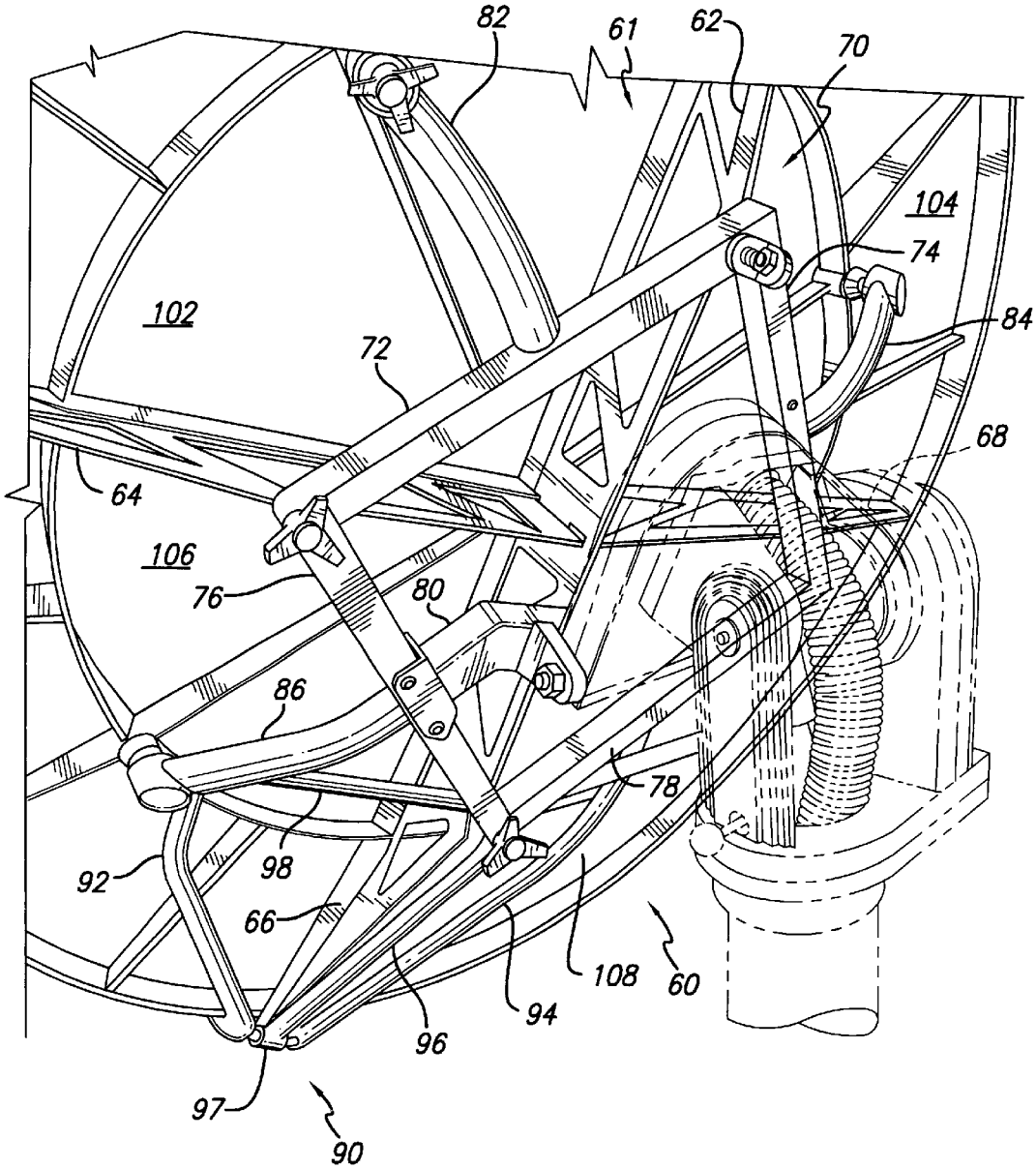
FIG. 8 illustrates a close-up view of a fully deployed antenna system, including a steering controller assembly supporting a back frame assembly which in turn supports an antenna dish, wherein the antenna system utilizes a preferred embodiment back frame assembly of the present invention which includes a center frame, a collapsible template assembly, and a feed leg mount to support the weight of a horn assembly, main feed leg, and amplifier.
Figure 8A:
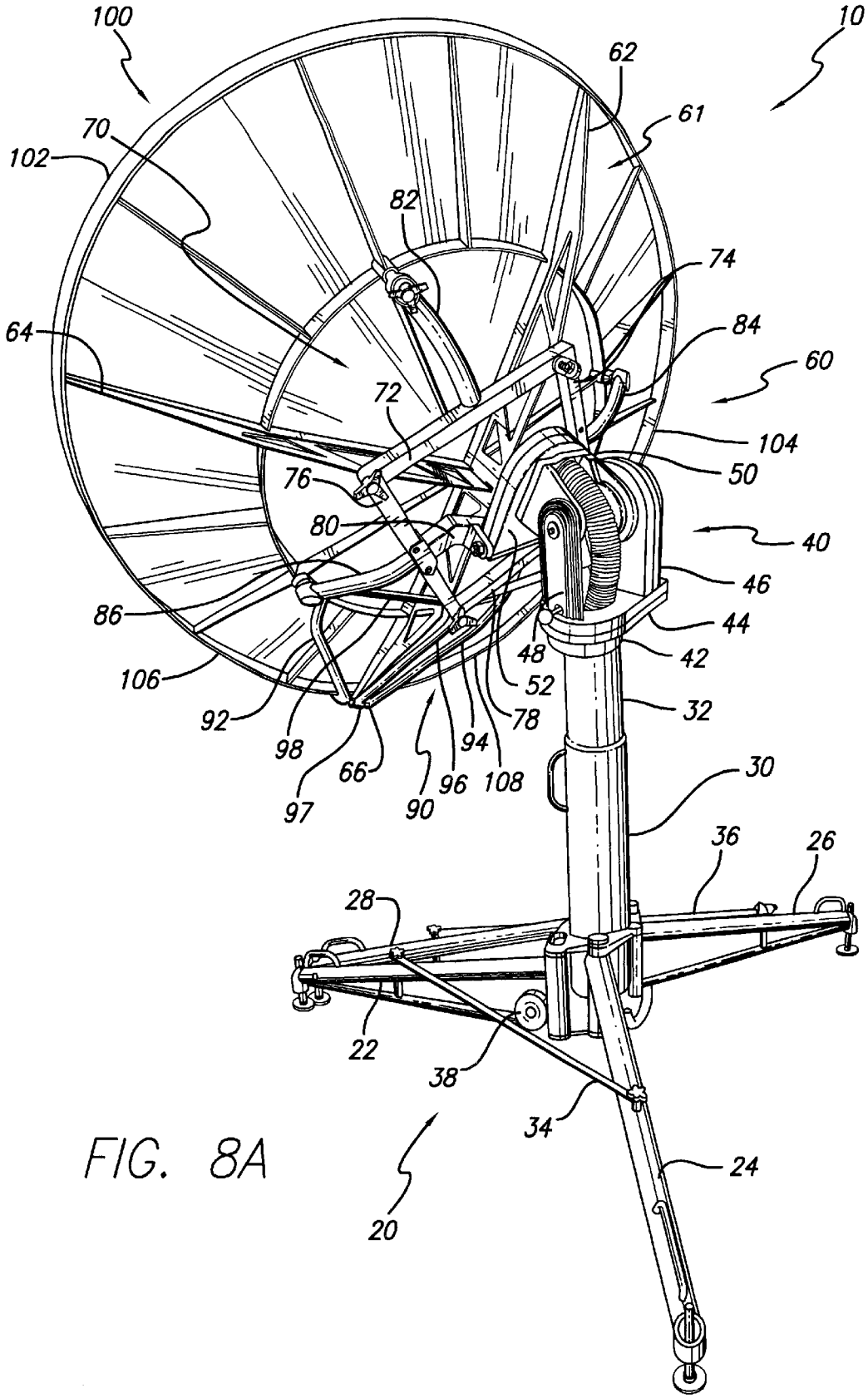
FIG. 8A illustrates a perspective view of a fully-deployed antenna system, including a quad pod mounting assembly in a deployed state for operation, a steering controller assembly, a back frame assembly, and an antenna dish, where the antenna system utilizes a preferred embodiment back frame assembly of the present invention that includes a center frame, a collapsible template assembly, and a feed leg mount to support the weight of a horn assembly, main feed leg, and amplifier.
Figure 9:
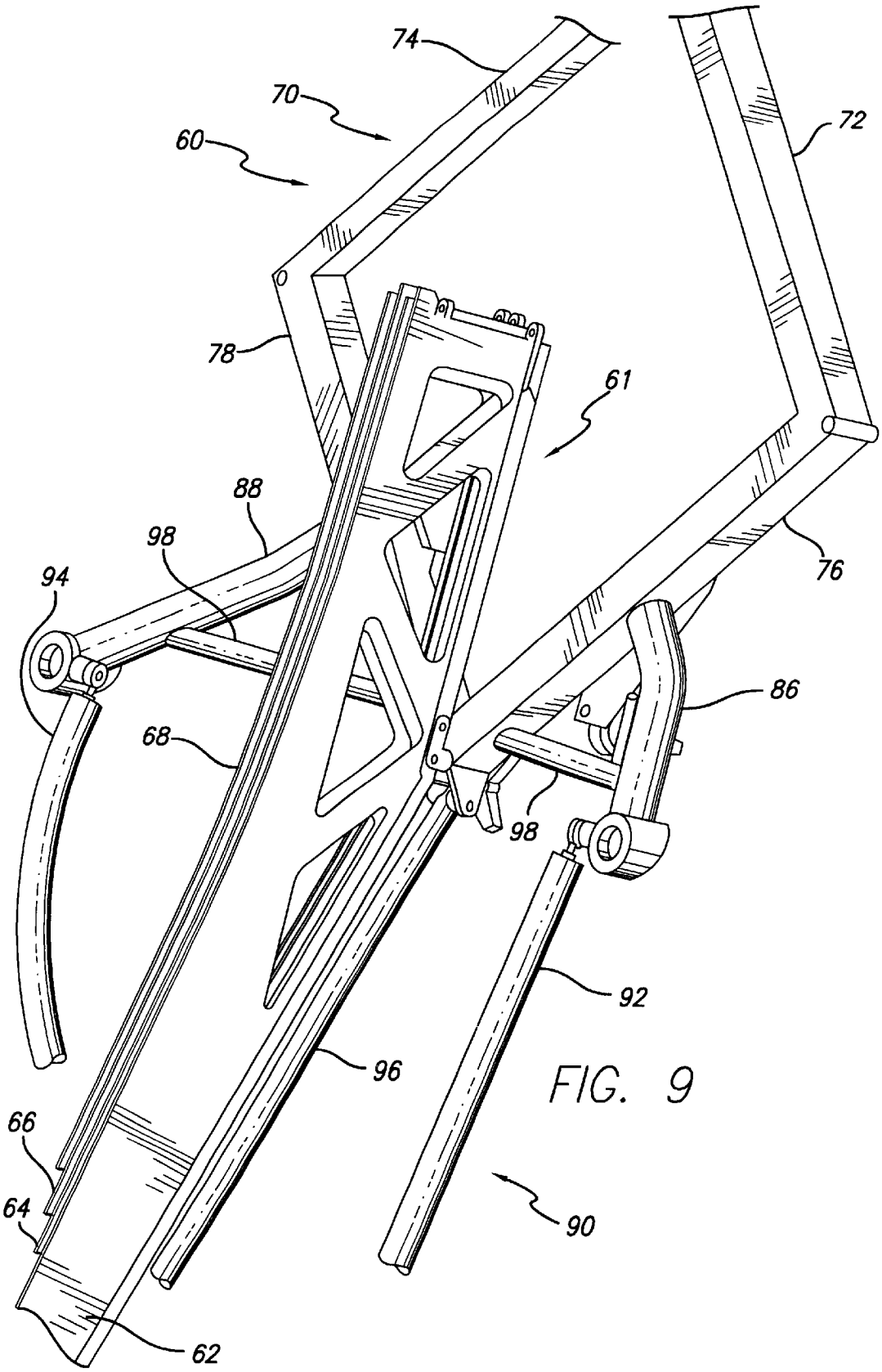
FIG. 9 illustrates a reverse partial close-up view of a preferred embodiment back frame assembly of the present invention that includes a center frame, a collapsible template assembly, and a feed leg mount, where the template assembly includes a plurality of leaves that are hinged at an intersection point and collapsed into a folded transportation state.

Referring now to FIGS. 7–9, there is shown a preferred embodiment of the present invention which contains a back frame 60 for supporting the dish assembly 100 and feed leg assembly 120 through attachment to the controller assembly 40. The back frame 60 is easy to assemble and allows for simplified manual adjustment of the dish assembly 100, if desired. The back frame 60 advantageously helps to minimize distortion of the dish assembly 100 by supporting the shape of the dish assembly. Distortion of the dish assembly 100 is detrimental in that it decreases the accuracy and efficiency of the antenna's transmitting ability. In some embodiments of the present invention, the back frame 60 can also be utilized in conjunction with a fixed antenna system, without the controller assembly 40 and pod mount assembly 20 described above.

In a preferred embodiment of the present invention, the back frame 60 includes a template assembly 61, a center frame 70, and a feed leg mount 90. The back frame 60 is used as an enhancement to antenna dish assembly 100, which in one preferred embodiment is a four-piece dish assembly. Previous back frame 60 designs have utilized a template assembly 61 that is constructed from two steel templates that intersect at the center of the dish and are sandwiched between the flanges of each dish quadrant. These prior stock templates were of a single piece design which made them long and flimsy, as well as vulnerable to damage during both shipping and installation.

As shown in FIG. 9, in one preferred embodiment of the present invention, the folding template assembly 61 is a single assembly that is double-hinged at the intersection point, halving the shipping length and making it easier to handle during installation. Specifically, the template assembly 61 includes four dish-engaging leaves 62, 64, 66, and 68 which are rotatably joined at the intersection point. These dish-engaging leaves 62, 64, 66, and 68 connect and provide support to the individual pieces of the dish assembly 100, thereby helping to minimize distortion of the dish assembly 100.

Referring again to FIGS. 8 and 8A, the template assembly 61 is shown connecting to the center frame 70 of the back frame 60. The center frame 70 is substantially square in configuration and is oriented such that comers of the square point upward and downward, thereby giving the center frame 70 a diamond-shaped appearance. The diamond shaped portion of the center frame 70 includes an upper right leg 72, an upper left leg 74, a lower right leg 76, and a lower left leg 78. At the comers (formed by these four legs 72, 74, 76, and 78) are the attachment points between the dish-engaging leaves 62, 64, 66, and 68 of template assembly 61 and the center frame 70. A cross-connect bar 80 connects between the lower right leg 76 and the lower left leg 78 of the center frame 70 to provide an attachment -point to the controller assembly 40 (or a base of a non-steerable mount), as well as for carrying lateral stresses. In another preferred embodiment, the cross-connect bar 80 can also connect between the upper right leg 72 and the upper left leg 74. From the midpoint of each of the frame legs 72, 74,76, and 78 extend connection arms which include an upper right arm 82, an upper left arm 84, a lower right arm 86, and a lower left arm 88. The ends of each of the connection arms 82, 84, 86, and 88 connect directly to the dish assembly 100 itself.

Extending downward from the center frame 70 of the back frame 60 is the feed leg mount 90. The feed leg mount 90 bears the weight of the main feed leg 122 of the feed leg assembly 120 (which is quite substantial) in order to help minimize any parametric distortions of the dish assembly 100 due to the weight of the main feed leg 122. The feed leg mount 90 includes a downward right support leg 92, a downward left support leg 94, a downward center support leg 96, a rotational mount 97, and a cross strut 98. Specifically, the right support leg 92 extends downward from the lower right connection 86; the left support leg 94 extends downward from the lower left connection arm 88; and the center support leg 96 extends downward from the intersecting comer of the lower right leg 76 and the lower left leg 78 of the diamond-shaped portion of the center frame 70. The lower ends of the right support leg 92, left support leg 94, and center support leg 96 all connect into the rotational mount 97. The rotational mount 97 provides a pivoting connection point for the main feed leg 122. The cross strut 98 extends between the lower right connection arm 86 and lower left connection arm 88 to help bear the lateral stresses incurred from both the weight of the dish assembly 100 and the weight of the main feed leg 122.

The preferred embodiment back frame 60, constructed in accordance with the present invention, as described above, utilizes a configuration which is designed to help maximize the stress-bearing and load-carrying capabilities of the back frame 60. In this manner, the weight of the back frame 60 can be reduced in comparison to that used in other antenna systems, because the back frame 60 of the present invention is capable of carrying larger loads due to the structural stress-bearing configuration of its components as opposed to the increased size of its components. The reduced weight of the back frame 60 also facilitates ease of assembly. Further, the back frame 60 and the steering controller assembly 40 can be scaled for use with an offset antenna dish from any manufacturer. Moreover, the back frame 60 of the antenna assembly 10 can be used without the controller assembly 40 to create a fixed antenna system which is easy to set up.

The back frame 60 also aids the assembly process through the use of a hanging assembly technique. Specifically, the back frame 60 is hung on an initial mounting point on the controller assembly 40 (or other base mount). This initial mounting point bears the weight of the back frame 60 and allows fine-tuning adjustments to be made, such that the back frame 60 can be secured into its final position without having to manipulate the weight of the entire back frame. As another example of this hanging assembly technique, the template assembly 61 is first hung on a mounting point on the back frame 60 to bear the weight of the template assembly. Then the dish-engaging leaves 62, 64, 66, and 68 are unfolded and secured into their final positions.

When an offset antenna design is utilized (as in one preferred embodiment of the present invention), the reference angle of the transmission beam is not readily apparent from general observation. However, a preferred embodiment back frame 60 of the present invention is able to insure precise elevation pointing, using the beam angle reference from a protractor (not shown) and adjustment screw (not shown), which are incorporated into the back frame structure. In some embodiments of the present invention, the protractor and adjustment screw are detachable from a mount located on the back frame 60, while in other embodiments of the present invention, the protractor and adjustment screw are fixedly attached to the back frame. An electronic compass (not shown) may also be attached to the back frame 60 in some preferred embodiments of the present invention. An electronic level meter (not shown) may also be attached to the back frame 60 in some preferred embodiments of the present invention. Thus, the back frame 60, itself, is able to help accurately assure proper horn/dish alignment of the antenna system 10. Those skilled in the art will appreciate that the back frame 60 described above can be used either in conjunction with or independently of the other components of the antenna assembly 10 described herein.

A preferred embodiment of the present invention also includes a dish assembly 100. As previously mentioned, the dish assembly 100 is of a multi-piece design for collapsibility and portability. In one preferred embodiment, the dish assembly 100 is constructed from four, wedge-shaped pieces, including an upper right wedge 102, an upper left wedge 104, a lower right wedge 106, and a lower left wedge 108. The wedges 102, 104, 106, and 108 all contain stiffeners in order to help minimize distortion of the shape of the dish assembly 100. The dish-engaging leaves 62, 64, 66, and 68 of the template assembly 61 are used to secure the wedges 102, 104, 106, and 108 together into the final assembled dish assembly 100. At the center of the dish assembly 100, where the wedges 102, 104, 106, and 108 all meet, is located the centerpoint of illumination 110. In other embodiments of the present invention, the dish assembly 100 may include either more or less pieces or wedges depending upon specific design considerations. In still other preferred embodiment dish assemblies 100 of the present invention, the dish-engaging leaves 62, 64, 66, and 68 are integrally formed with the wedges 102, 104, 106, and 108 of the dish assembly 100.

Figure 10:
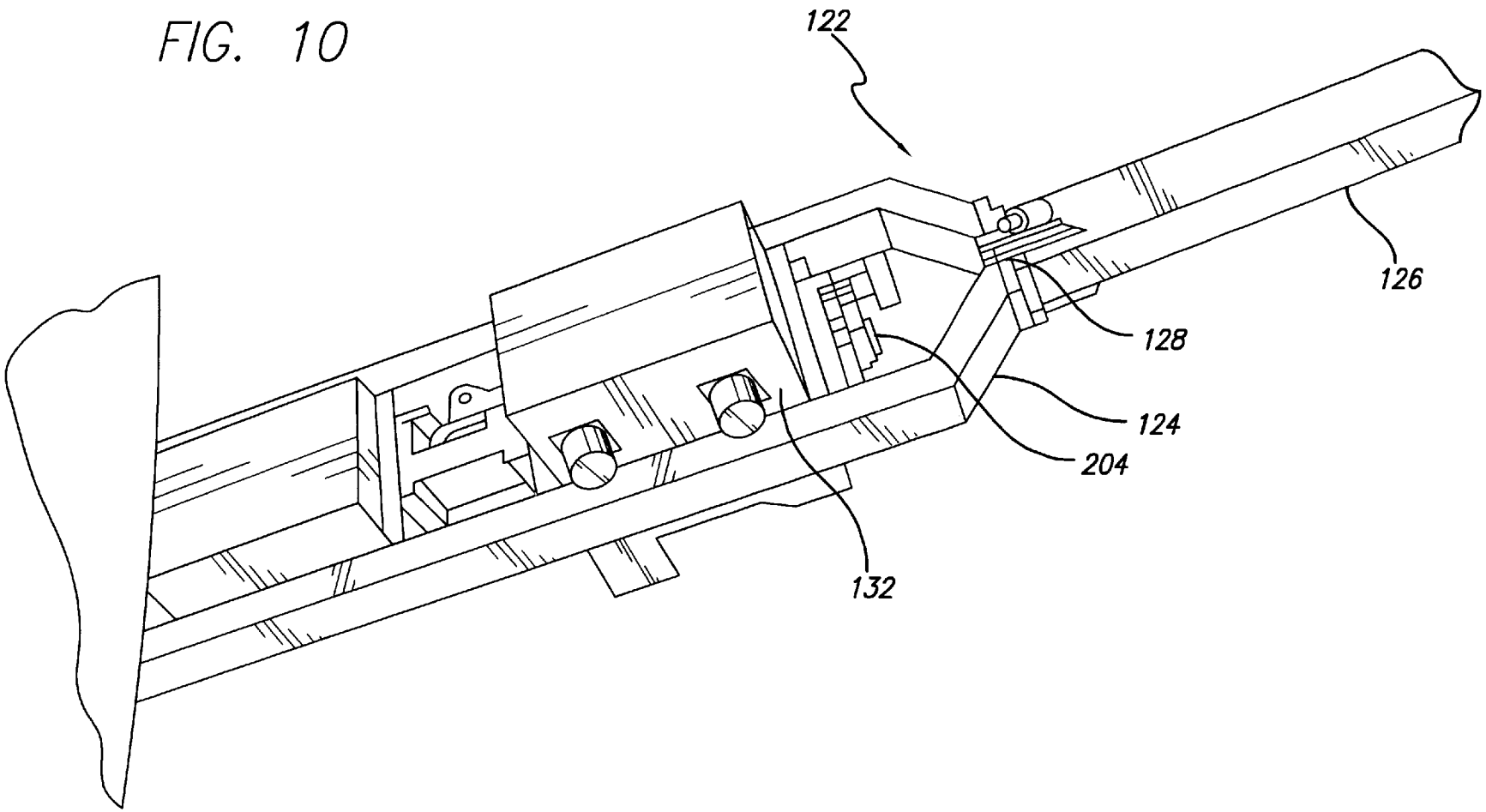
FIG. 10 illustrates a perspective view of a preferred embodiment main feed leg assembly of the present invention that includes a feed strut, an amplifier frame, quick release latch, an uplink amplifier, and a mating wave guide fitting.
Figure 11:
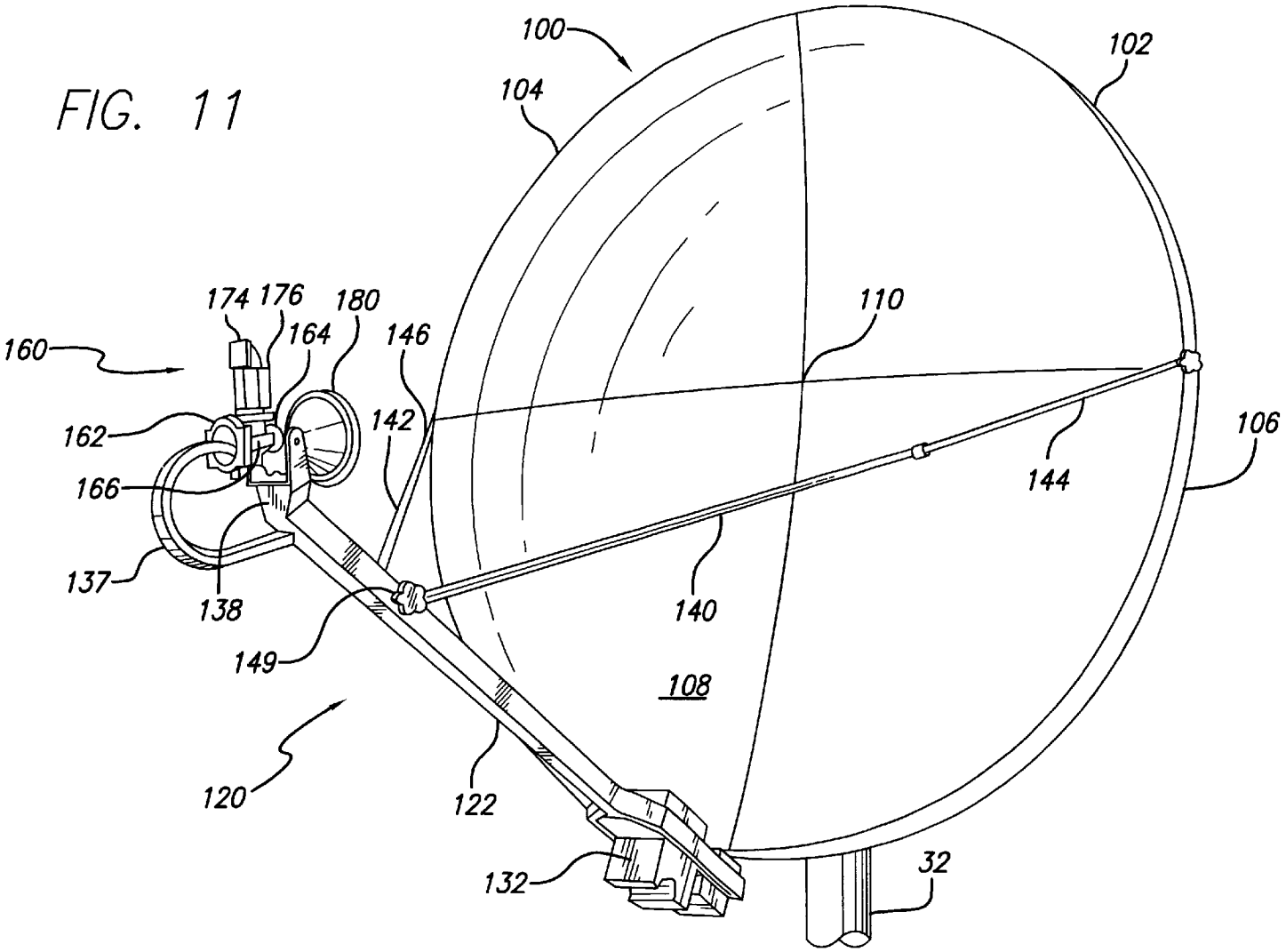
FIG. 11 illustrates a perspective view of a preferred embodiment feed leg assembly of the present invention that includes two side feed legs and a main feed leg assembly for supporting and positioning the horn assembly with respect to the antenna dish.

Referring now to FIGS. 10 and 11, there is shown a preferred embodiment feed leg assembly 120, constructed in accordance with the present invention, and including a main feed leg 122, a right side feed leg 140, and a left side feed leg 142. The main feed leg 122 is a combination of an amp frame 124, a feed strut 126, a quick release latch 128, an uplink amplifier 132, a mating wave guide fitting 204, a flexible wave guide 137, and a wave guide end fitting 208. The major structural members of the main feed leg 122 are the amp frame 124 and the feed strut 126, which are selectively attachable and detachable from one another with the use of the quick release latch 128. The quick release latch 128 is located at the head of the amp frame 124 where it attaches to the base of the feed strut 126. The quick release latch 128 allows the amp frame 124 and the feed strut 126 to separate for transport without the need for tools, thus increasing the modularity and portability of the main feed leg 122.

Preferably, the amp frame 124 and the feed strut 126 are constructed from a tubular type structure which helps reduce the overall weight of the main feed leg 122.

In one preferred embodiment of the present invention, the amp frame 124 is configured in an encompassing design. This helps to protect the uplink amplifier 132 and the mating wave guide fitting 204, which are surrounded by the outer structure of the amp frame. The uplink amplifier 132 and the mating wave guide fitting 204 are sensitive components that benefit from the increased protection provided by the amp frame 124. Additionally, this design of the amp frame 124 provides a protective structure around the uplink amplifier 132 and the mating wave guide fitting 204, and is also beneficial in that it lowers the overall profile and center of balance of the main feed leg 122. This results in easier manipulation and alignment of the dish assembly 100.

The feed strut 126 is hollow which allows the flexible wave guide 137 to pass through the inside of the feed strut. The flexible wave guide 137 attaches to the uplink amplifier 132 (through the wave guide end fitting 208 and the mating wave guide fitting 204) and carries the transmission signal to the horn assembly 180. The main feed leg 122 also contains a frame mount at the base of the amp frame 124 (for connecting to the rotational mount 97 of the feed leg mount 90), and a horn mount attachment 138 at the head of the feed strut 126 for connecting to the horn mount assembly 160. Those skilled in the art will appreciate that the main feed leg 122 described above can be used either in conjunction with, or independently of the other components of the antenna assembly 10 as described herein.

Figure 12:
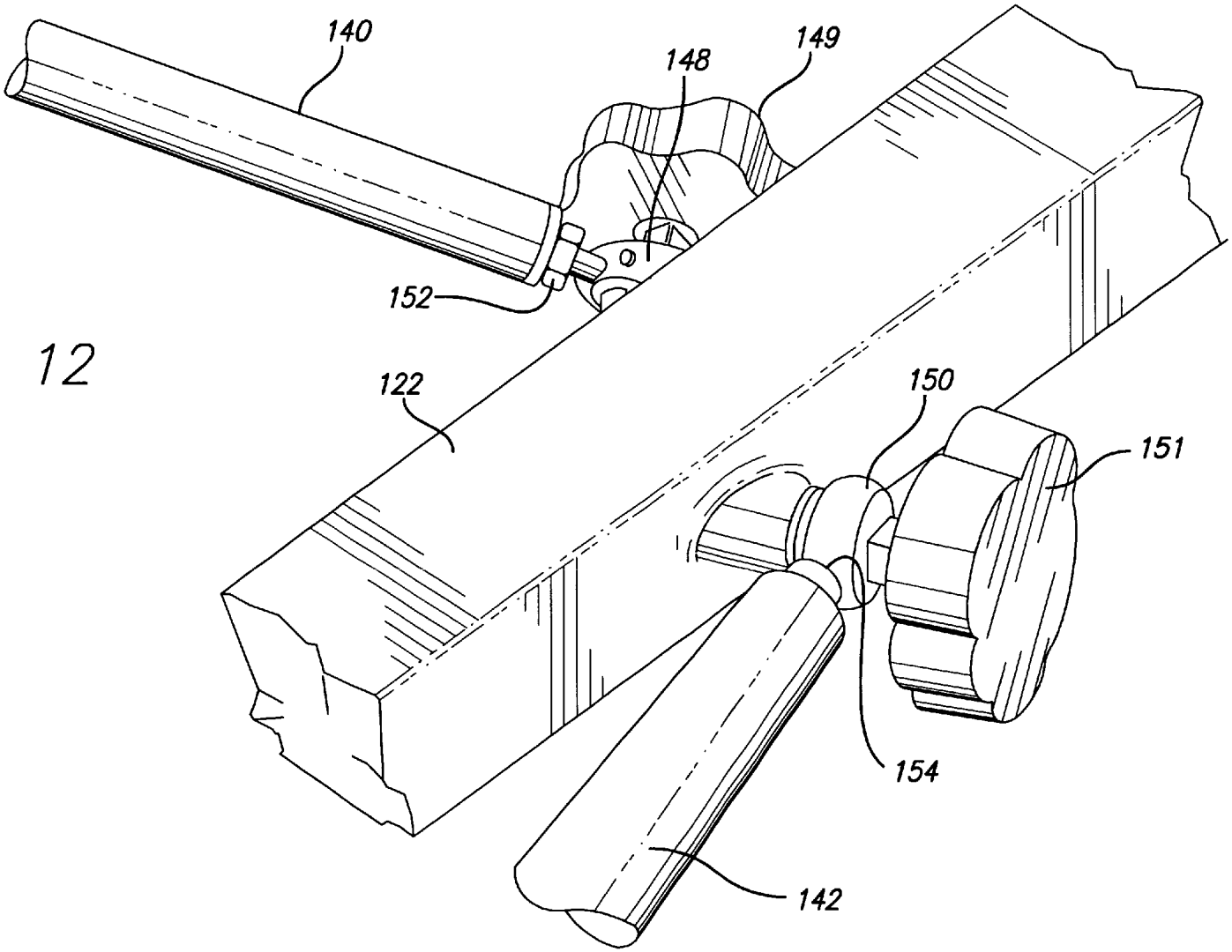
FIG. 12 illustrates a partial close-up view of the feed leg assembly of FIG. 11 showing the side feed legs connecting to the main feed leg assembly through Hein joints, with the side feed legs acting as turnbuckles having lock down nuts.
Figure 12A:
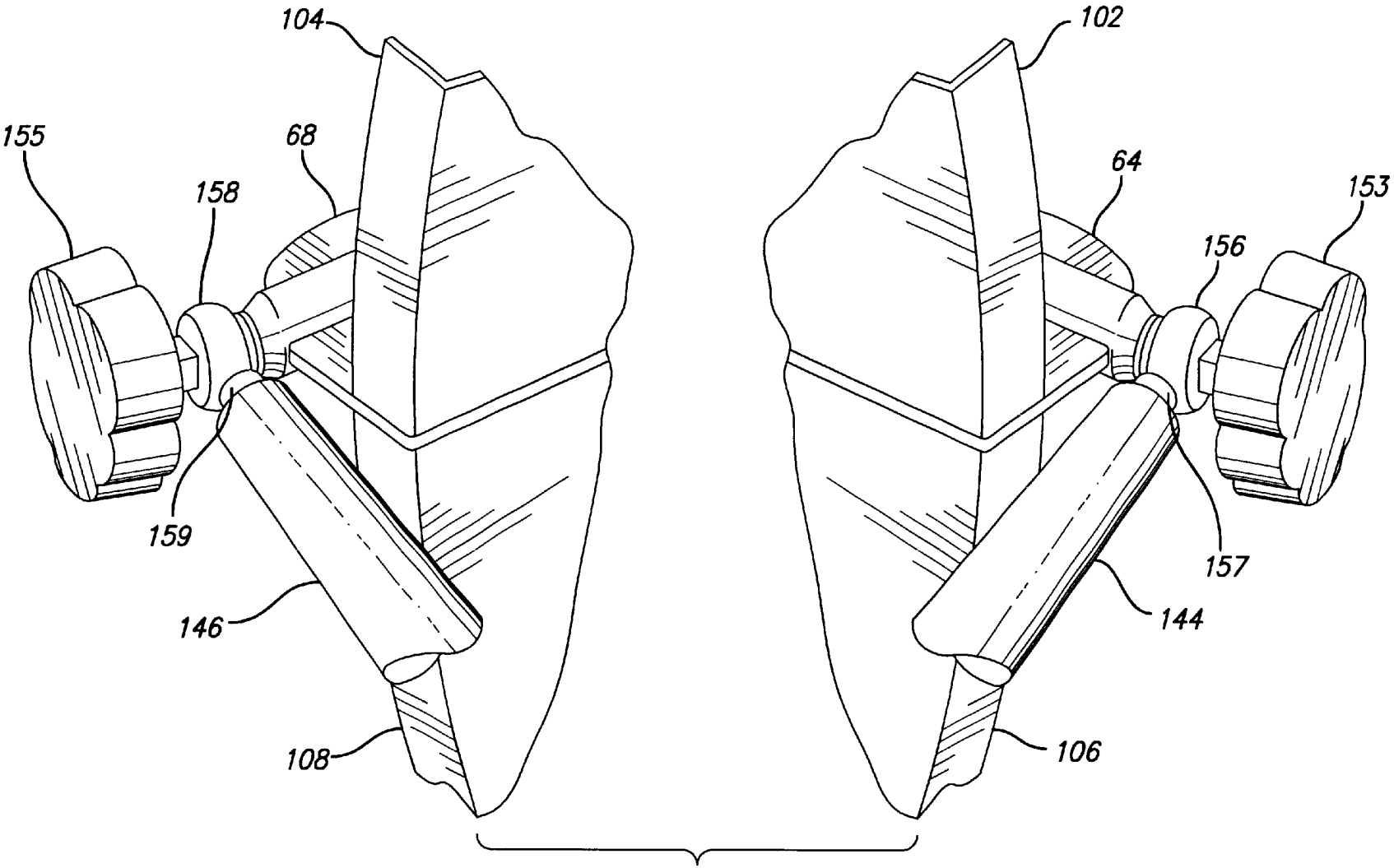
FIG. 12A illustrates partial close-up views of the feed leg assembly of FIG. 11 showing the side feed legs connecting to the back frame template assembly through Hein joints, with the side feed legs acting as turnbuckles having lock down nuts.

As shown in FIGS. 11, 12, and 12A the left and right side feed legs 142 and 140 connect to the feed strut 126 of the main feed leg 122 and to the ends of two of the disengaging leaves 68 and 64 of the template assembly 61. The right side feed leg 140 includes a right telescoping extension 144, and the left side feed leg 142 includes a left telescoping extension 146. These telescoping extensions 144 and 146 of the side feed legs 140 and 142 act to increase the modularity and portability of the feed leg assembly 120.

The right and left side feed legs 140 and 142 attach to the feed strut 126 of the main feed leg 122 and act as turn buckles. In one preferred embodiment of the present invention, each side feed leg has Hein joints at both ends. However, in other preferred embodiments of the present invention, other end connectors may be utilized. Hein joints are utilized in one preferred embodiment because they provide the freest range of motion in a ball and socket joint while having the least amount of play, as compared to other connectors. Side feed leg Hein joints 148 and 150 attach to the main feed leg 122 and are connected to the side feed legs 140 and 142 with right-handed threads. Side feed leg Hein joints 156 and 158 attach to the template leaves 64 and 68, and are connected to the side feed legs 140 and 142 with left 5 handed threads. Each Hein joint 148, 150, 156, and 158 on each end of the side feed legs attaches to its connection point with a quick release knob 149, 151, 153, and 155 to allow quick attachment and removal of the side feed legs.

By rotating the entire side feed legs 140 and 142 around their longitudinal axis, counterclockwise or clockwise as viewed from the perspective of the horn pointing toward the dish, the effective length of side feed legs 140 and 142 is either shortened or lengthened. Thus, both side feed legs act as long tumbuckles. Since the horn assembly 180 and horn mount assembly 160 are attached to the end of the main feed leg 122, shortening the side feed legs effectively raises the main feed leg, the horn mount assembly, and most importantly the horn assembly upwards and inwards towards the dish assembly 100 for horn/dish alignment purposes. Similarly, lengthening the side feed legs effectively lowers the main feed leg, the horn mount assembly, and most importantly the horn assembly downwards and outwards from the dish assembly 100 for horn/dish alignment purposes. The main feed leg 122 is raised by pivoting around the rotational mount 97 of the back frame 60.

When the desired dish/horn alignment has been achieved through the rotation of the side feed legs 140 and 142, right and left lockdown nuts 152 ,154, 157, and 159 are then tightened to secure the side feed legs 140 and 142 into position and prevent any undesired movement of the side feed legs. The feed leg assembly 120 allows for maximum flexibility and compatibility with other antenna system components due to the telescoping extensions 144 and 146, ;adjustable turn buckle action of the Hein joints 148, 150, 156, and 158 of the side feed legs 140 and 142; and in combination with the detachable (and thus, easily interchangeable) feed strut 126 of the main feed leg 122. Those skilled in the art will appreciate that the feed leg assembly 120 described above can be used either in conjunction with or independently of the other components of the antenna assembly 10 described herein.

Figure 13:
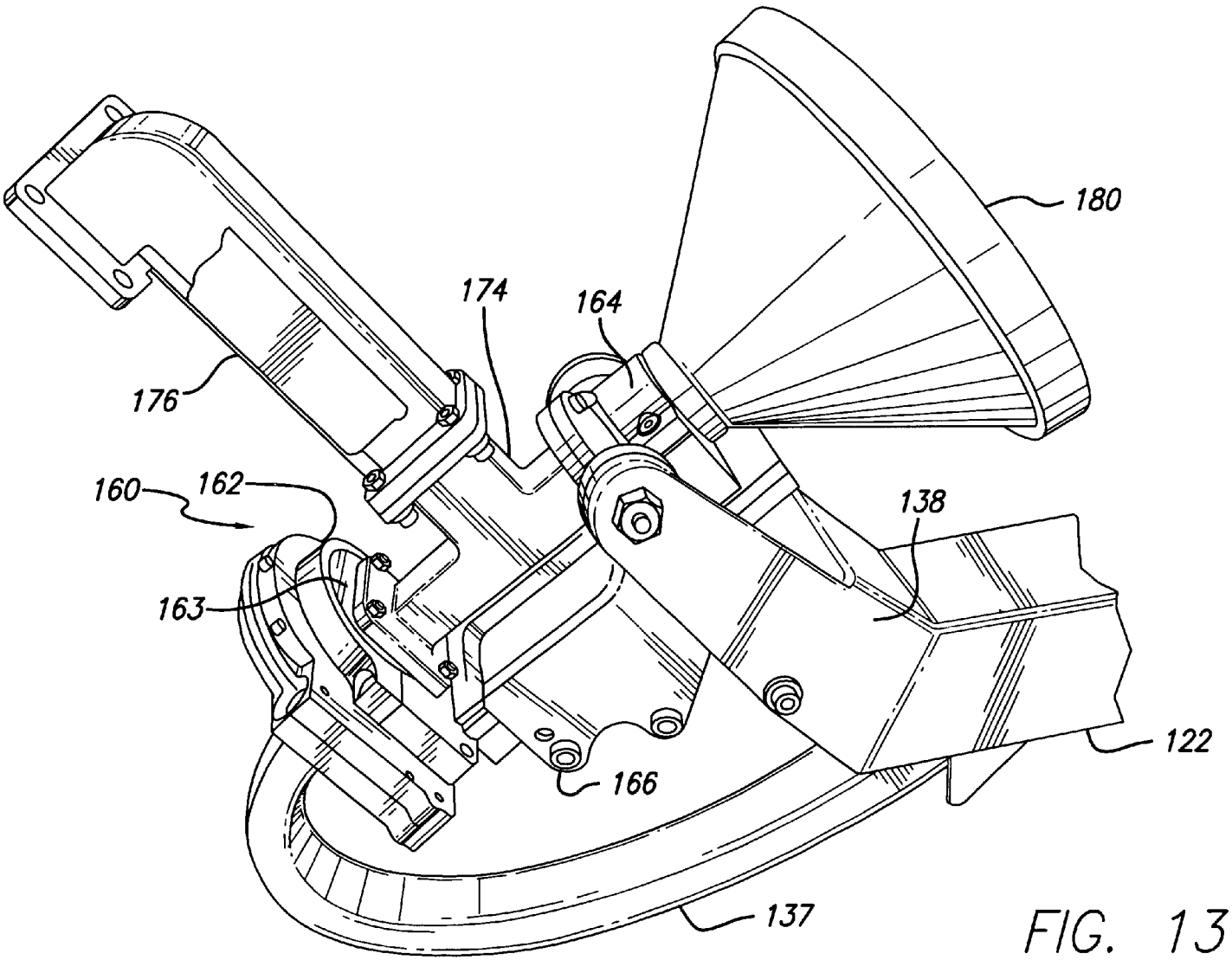
FIG. 13 illustrates a perspective view of the horn mount assembly attached to the main feed leg assembly, horn assembly, flexible wave guide, and horn-mounted polarization drive assembly.
Figure 14:
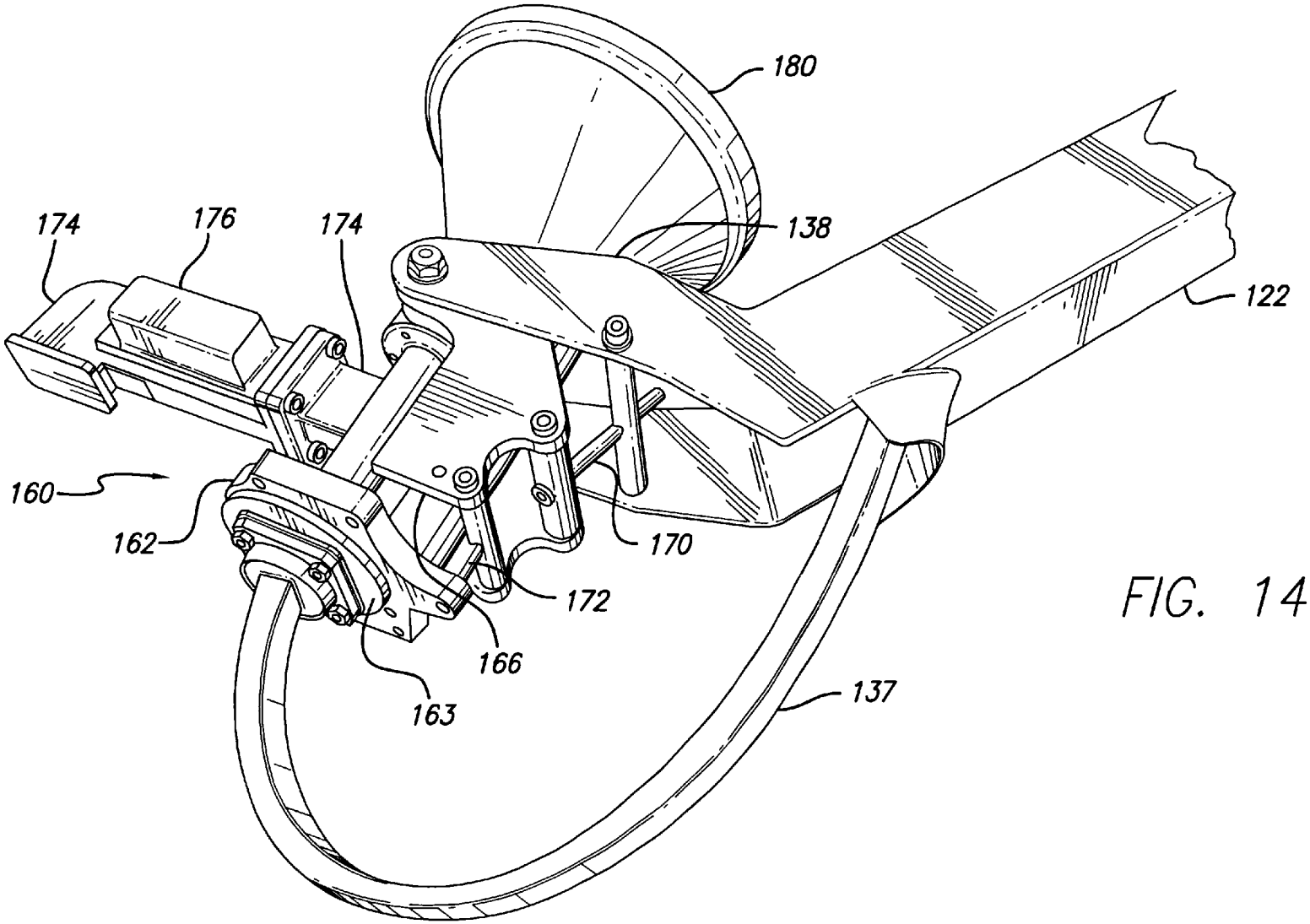
FIG. 14 illustrates a rear perspective view of the horn mount assembly attached to the main feed leg assembly, horn assembly, and flexible wave guide.

Referring now to FIGS. 13 and 14, there is shown a preferred embodiment of the present invention that also includes a horn mount assembly 160 for attaching the horn assembly 180 to the main feed leg 122. Prior horn mounts have functioned solely as a static adjustment piece and, as such, have been fixed on most, if not all axes, thus making it difficult, if not impossible, to adjust the horn assembly 180 itself into an exact position. Advantageously, the horn mount assembly 160 of the present invention provides fine jack screw adjustments on the Y-Z tilt axis, as well as along the beam axis (z-axis). One preferred embodiment horn mount assembly 160 includes a wave guide mount circular clamp 162, a flexible wave guide mount 163, a horn circular clamp 164, a feed strut attachment plate 166, a Y-Z tilt jack screw 170, and a Z-axis jack screw 172. The feed strut attachment 166 of the horn mount assembly 160 attaches to the horn mount attachment 138 on the main feed leg 122. The horn assembly 180 is secured by the horn circular clamp 164, which preferably separates into two pieces in order to secure the horn assembly 180 there between. The flexible wave guide mount 163 is secured by the wave guide mount circular clamp 162, which preferably separates into two pieces in order to secure the flexible wave guide mount 163 there between. The flexible wave guide 137 (which travels up the inside of the main feed leg 122) connects to the flexible wave guide mount 163.

The z-axis jack screw 172 allows the horn assembly 180 to be moved along the horn transmission beam axis towards and away from the centerpoint of illumination 110 of the dish assembly 100, thereby decreasing or increasing the focal length, respectively. The Y-Z tilt jack screw 170 allows the horn assembly 180 to pivot in a vertical plane, thereby vertically adjusting the transmission beam's central point with respect to the centerpoint of illumination 110. In conjunction with the adjustable main feed leg 122 and side feed legs 140, and 142, the horn mount assembly 160 can position the horn assembly 180 both easily and accurately. Additionally, the wave guide mount circular clamp 162 of the horn mount assembly 160 is configured to readily accept the horn mounted polarization drive assembly 190, discussed in further detail below. Those skilled in the art will appreciate that the horn mount assembly 160 described above can be used either in conjunction with or independently of the other components of the antenna assembly 10 as described herein.

The horn assembly 180 itself is a standard component and is interchangeable depending upon the desired functionality of the antenna assembly 10. The extreme adjustability and flexibility of the horn mount assembly 160 and feed leg assembly 120 allow this interchangeability of the horn assembly 180 to be achieved. An orthomode transducer 174 (OMT) and rejection filter 176 are also standard components in the antenna assembly 10 and are attached to the horn mount assembly 160.

Figure 15:
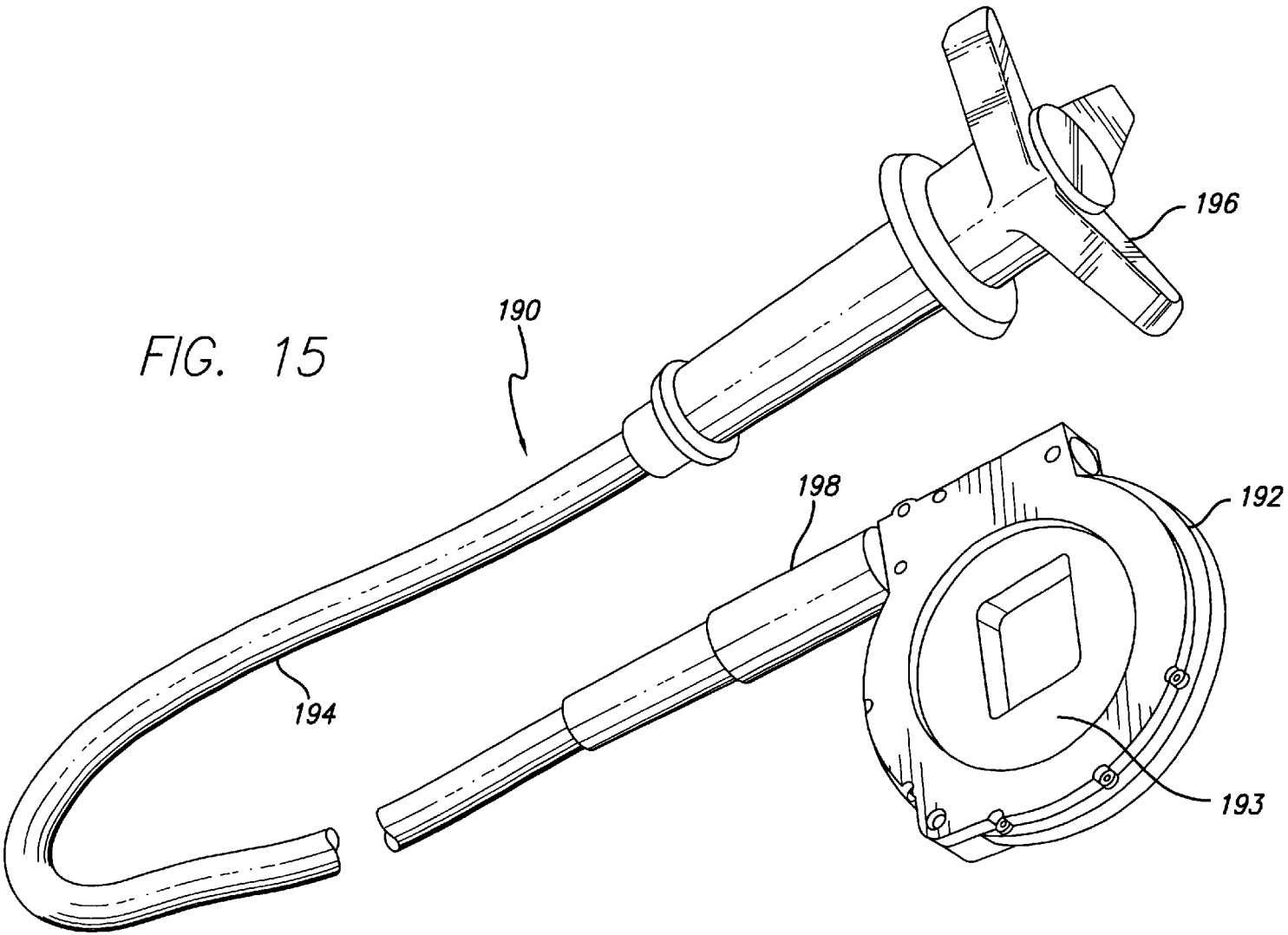
FIG. 15 illustrates an isolation view of a preferred embodiment horn mounted polarization drive assembly of the present invention that includes a worm drive, a flex drive torque cable, and an adjustment knob.
Figure 16:
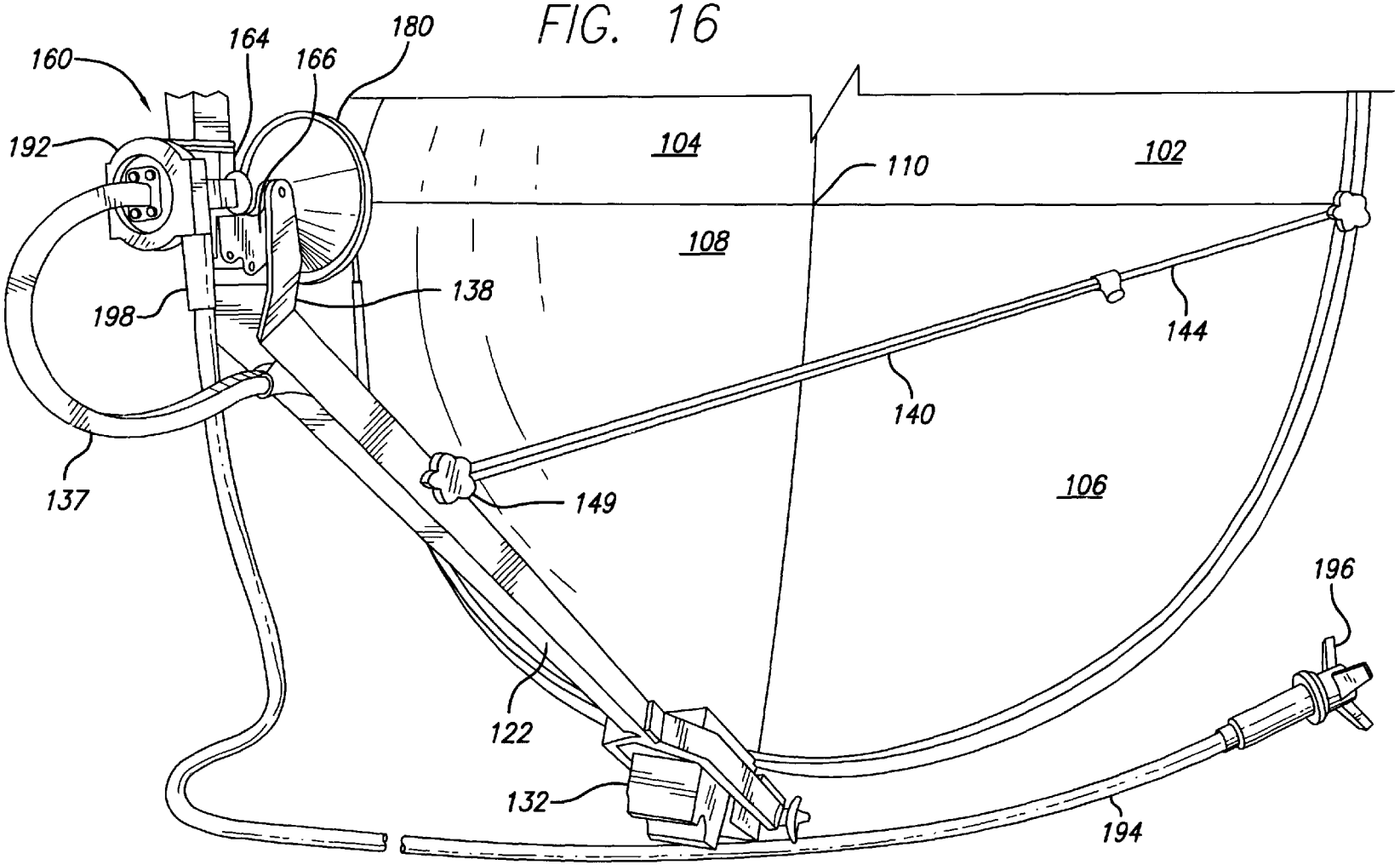
FIG. 16 illustrates a perspective view of the horn-mounted polarization drive assembly of FIG. 15 that is attached to the horn mount assembly and associated antenna system.
Figure 17:
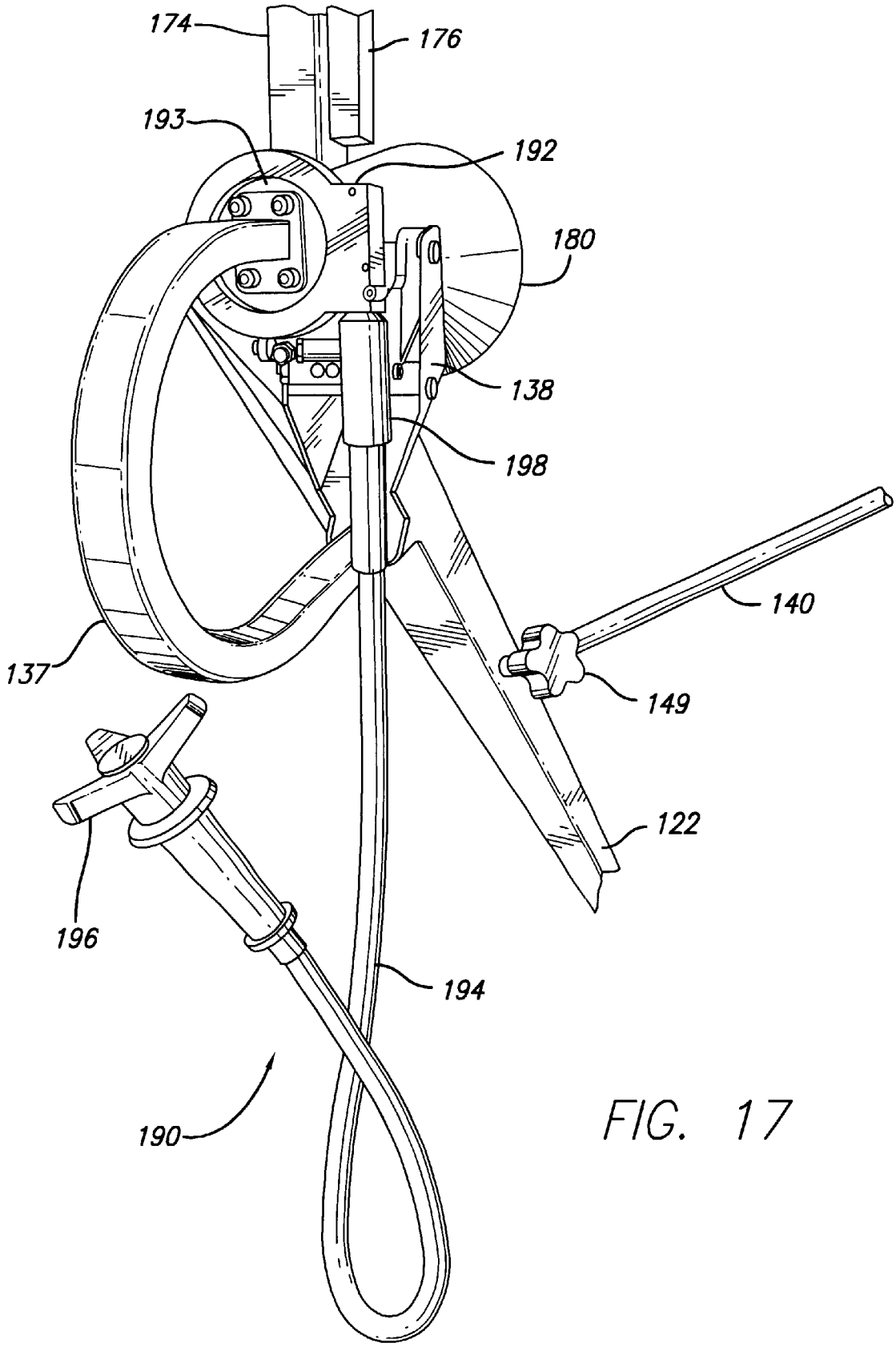
FIG. 17 illustrates a partial close-up view of the horn-mounted polarization drive assembly of FIG. 15 that is attached to the horn mount assembly and feed leg assembly.

Referring now to FIGS. 15–17, there is shown one preferred embodiment of the present invention that includes a horn mounted polarization drive assembly 190. Preferably, the horn mounted polarization drive assembly 190 includes a manual worm drive 192 and is used to remotely adjust the polarity of the horn assembly 180 while the system is actively transmitting and/or receiving a signal. In one preferred embodiment, the polarization drive assembly 190 includes a worm drive 192, a torque plate 193, a flex drive torque cable 194, an adjustment knob 196, and a cable disconnect 198. The worm drive 192 of the drive assembly 190 connects to a stationary portion of the horn mount assembly 160 (e.g., the wave guide mount circular clamp 162) in order to rotate (adjust the polarity of) the attached horn assembly 180 with respect to the horn mount assembly. The polarization drive assembly 190 rotates the horn assembly 180 by using the torque plate 193 to apply torque to the wave guide fitting of the flexible wave guide mount 163 and also to the end fitting of the flexible wave guide 137. One end of the flex drive torque cable 194 connects to the worm drive 192 through the cable disconnect 198, and the other end of the torque cable 194 (sometimes referred to as a speedometer cable) ends in the adjustment knob 196.

The flex drive torque cable 194 of the manual polarization drive assembly 190 is long enough to reach from the horn mount assembly 160 to a position located behind the dish assembly 100. The horn mounted polarization drive assembly 190 uses the flex drive torque cable 194 to allow an operator to stand behind the dish (i.e., away from the transmission field) but still allowing use of the adjustment knob 196 to manually adjust the polar orientation of the horn assembly 180, using the polarization worm drive 192 while the antenna system 10 is operating and microwaves are being generated.

In operation, the antenna assembly 10 transmits microwaves that are highly dangerous and, thus, prohibits anyone from being in front of the dish assembly 100 when the antenna system 10 is transmitting. However, it is extremely difficult to align an antenna system 10 when the system is not transmitting. Accordingly, prior manual polarization drives have been relegated to the undesirable process of discontinuing the antenna transmissions, making an alignment adjustment (through guess-work since no transmission signal can be detected), once again generating antenna transmissions and taking a reading, discontinuing the antenna transmissions, making another guess-work alignment adjustment, and so on. In more expensive systems, motorized horn mounted polarization drives have been used which allow the antenna system 10 to be aligned while the system is transmitting, but these are more delicate and cost prohibitive. The polarization drive assembly 190 of the present invention provides the benefits of an expensive, motorized system, but with the simplicity, affordability, and reliability of a manual drive assembly.

In a preferred embodiment horn mounted polarization drive assembly 190, constructed in accordance with the present invention, the flex drive torque cable 194 is easily detachable from the horn mounted polarization worm drive 192, using the cable disconnect 198 when the adjustments are completed. In this manner, the worm drive 192 can be left attached to the horn mount assembly 160 when the antenna assembly 10 is operating, if desired. The polarization worm drive 192 of the drive assembly 190 attaches onto the back of the horn mount assembly 160 where it is quickly and simply installable and removable. Additionally, the horn mounted polarization worm drive assembly 190 can be utilized in conjunction with both rapidly-deployable mobile antenna systems 10 (as in a preferred embodiment of the present invention), as well as with rigidly-mounted dish antenna systems. Those skilled in the art will appreciate that the polarization drive assembly 190 described above can be used either in conjunction with or independently of the other components of the antenna assembly 10 described herein.

Figure 18:
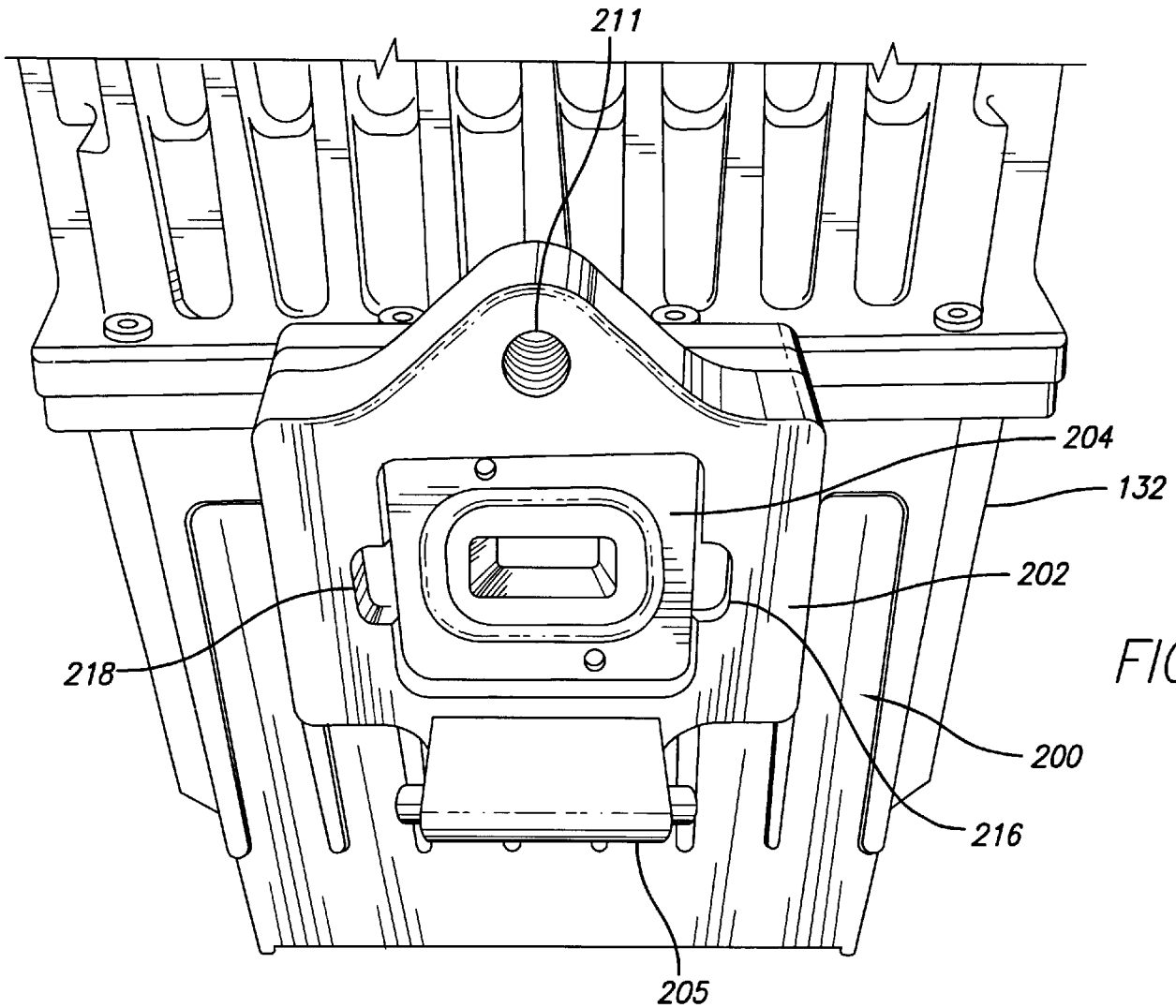
FIG. 18 illustrates a front view of an uplink amplifier, attached amplifier wave guide fitting, and receiver of a wave guide quick disconnect assembly.
Figure 19:
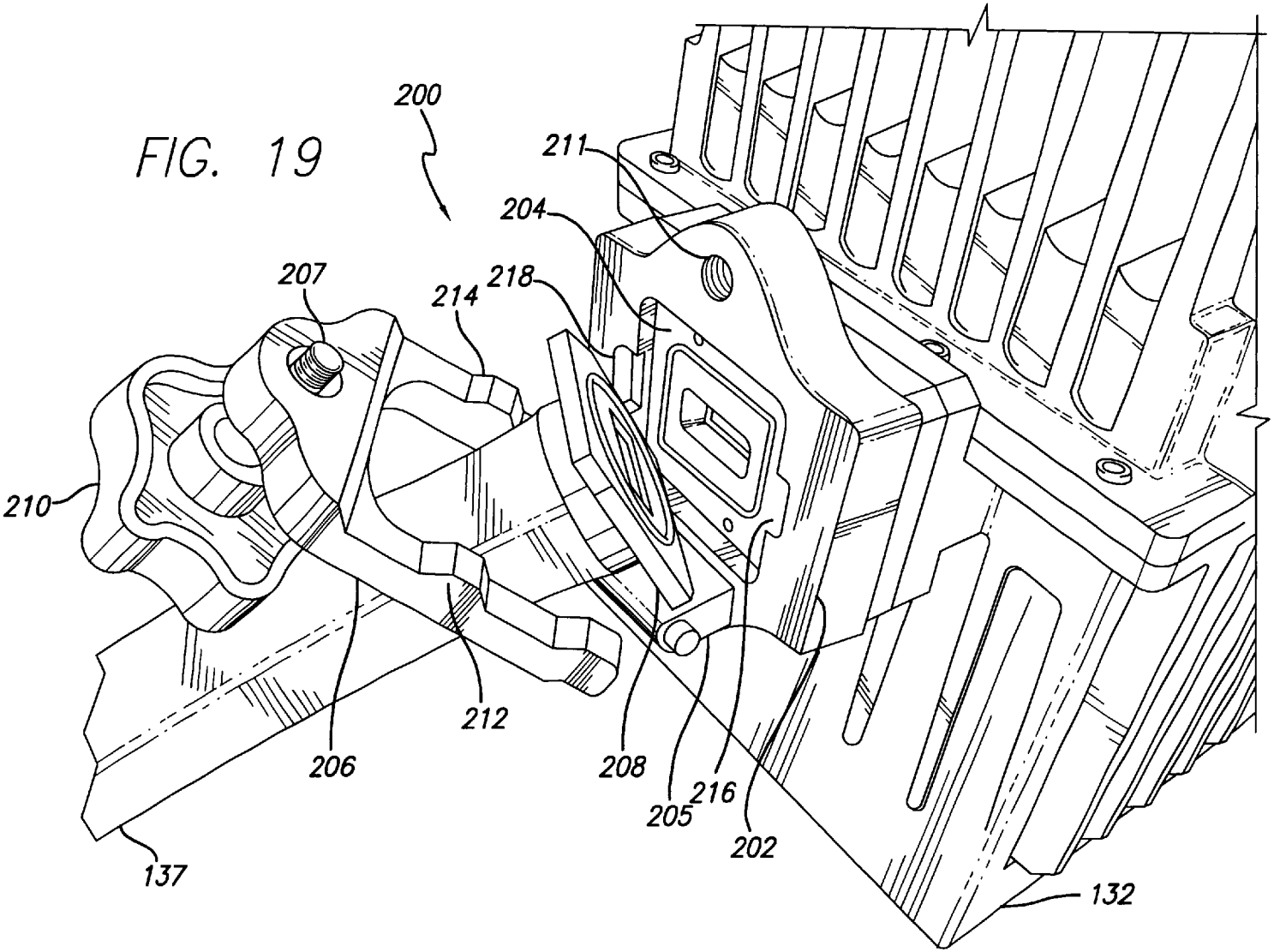
FIG. 19 illustrates a perspective view of a quick disconnect assembly of the present invention that includes a flexible wave guide and wave guide end fitting being inserted into a receiver and attached amplifier wave guide fitting for fastening by a fork and securement knob.
Figure 20:
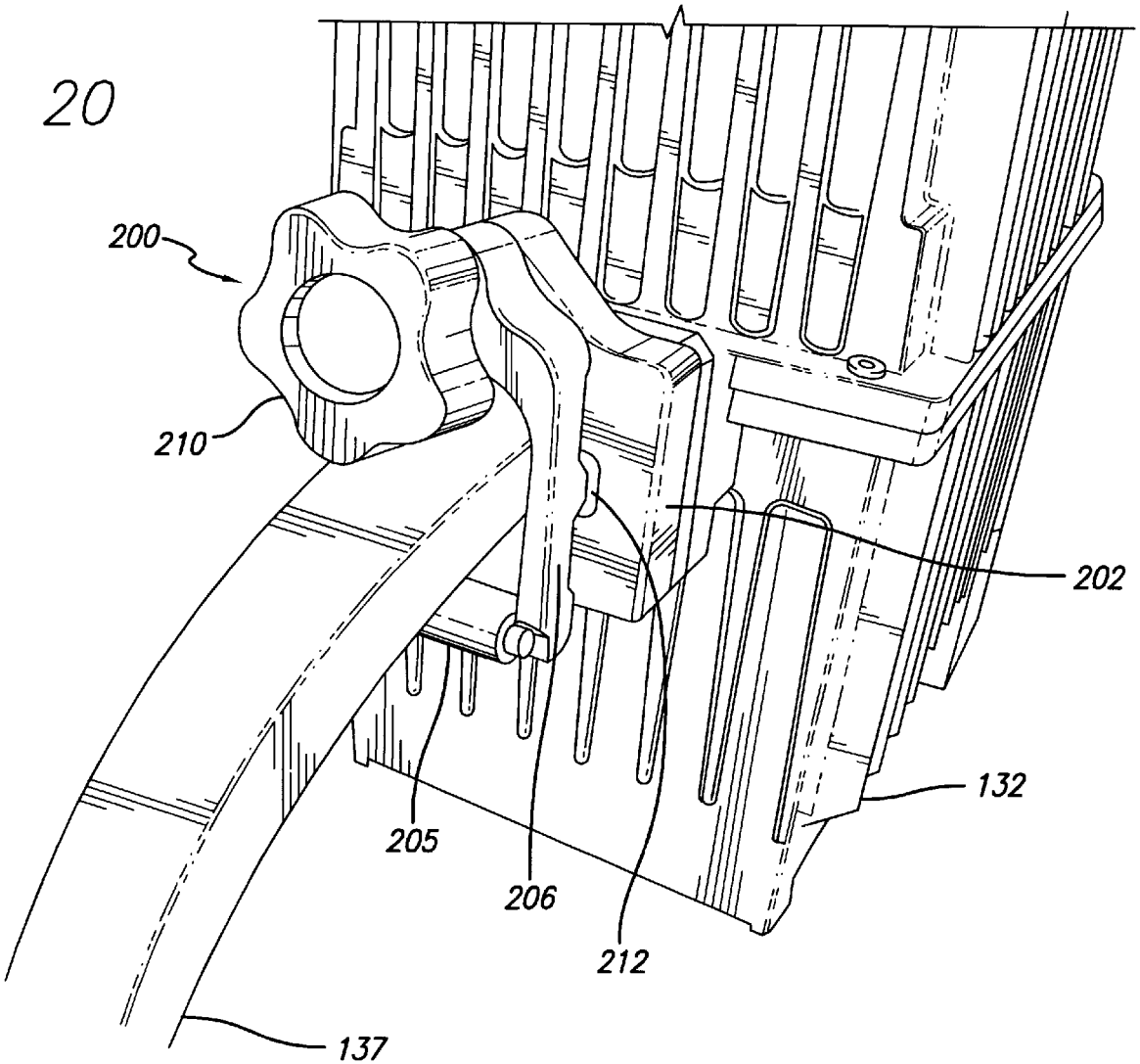
FIG. 20 illustrates a perspective view of a wave guide quick disconnect assembly of the present invention that includes a wave guide and end fitting fully inserted into a receiver and attached amplifier wave guide fitting and fastened by a fork and securement knob.

As shown in FIGS. 18–20, a preferred embodiment quick disconnect assembly 200, constructed in accordance with the present invention, simply and quickly connects two components to one another with the high degree of accuracy while eliminating small, losable parts. In one preferred embodiment, the quick disconnect assembly 200 is used to release the flexible wave guide 137 from the amplifier 132. Normally, flexible wave guide 137 is attached to the amplifier 132 with four or more very small screws and the use of a screw driver. However, this type of connection is not practical or reliable for many situations, including field use, where fumbling with small parts is time-consuming and subject to part loss. The wave guide quick disconnect assembly 200 of the present invention virtually eliminates the use of losable parts as well as the need for additional tools.

A preferred embodiment wave guide quick disconnect assembly 200 includes a receiver 202 and a fork 206. The receiver 202 is attached to a mating wave guide fitting 204 (on the amplifier 132) and remains secured to the mating wave guide fitting 204 at all times. A fork end brace 205 extends out from the receiver 202 on the lower side of the receiver to provide an attachment flange for the fork 206. The flexible wave guide 137 has an end fitting 208 that is correspondingly shaped to house within the receiver 202. The fork 206 is preferably attached via a lanyard (not shown) to the end of the wave guide end fitting 208 so that the fork 206 can not be lost. The fork 206 also includes a securement knob 210 having threadings 207 that projects through the base of the fork. Rotation of the securement knob 210 advances or retracts the threadings 207. Additionally, the left and right legs of the fork 206 contain protrusions 212 and 214 which are correspondingly shaped to mate with left and right depressions 216 and 218 in the receiver 202.

In order to connect the flexible wave guide 137 to the uplink amplifier 132, the end fitting 208 of the wave guide is inserted into the receiver 202. The fork 206 is then lowered over the flexible wave guide 137 into position until the ends of the fork seat under the fork end brace 205. The fork 206 is then rotated about the fork end brace 205 until the fork leg protrusions 212 and 214 seat within the receiver depressions 216 and 218, and the fork is substantially flush against the receiver 202. The securement knob 210 is then hand-tightened causing the threadings 207 to secure into a correspondingly threaded aperture 211 in the receiver 202 to complete the installation. The fork leg protrusions 212 and 214 place pressure on the wave guide end fitting 208, thus causing evenly distributed pressure to be placed between the wave guide end fitting 208 and the mating wave guide fitting 204. The flexible wave guide 137 can be simply and easily removed from the uplink amplifier 132 by reversing the above-described process.

The quick disconnect assembly 200 provides many advantages over previously used securement techniques, including by way of example only, simplification of assembly, reduction in parts, elimination of losable parts, and the elimination of additional tooling required to connect the component parts (e.g., a screw driver). Moreover, the wave guide quick disconnect assembly 200 also provides superior registration of the wave guide opening on the faces of the mating wave guide fitting 204 and the wave guide end fitting 208. This is due to the fact that the configuration of the receiver 202 and the fork 206 force the wave guide end fitting 208 to seat with an optimal alignment with the mating wave guide fitting 204. In other preferred embodiments of the present invention, the quick disconnect assembly 200 is utilized in many numerous other applications whenever it is desired to accurately connect two components together in a simple configuration that eliminates the need for losable parts and excess tools. Those skilled in the art will appreciate that the quick disconnect assembly 200 described above can be used either in conjunction with or independently of the other components of the antenna assembly 10 described herein.

Figure 21:
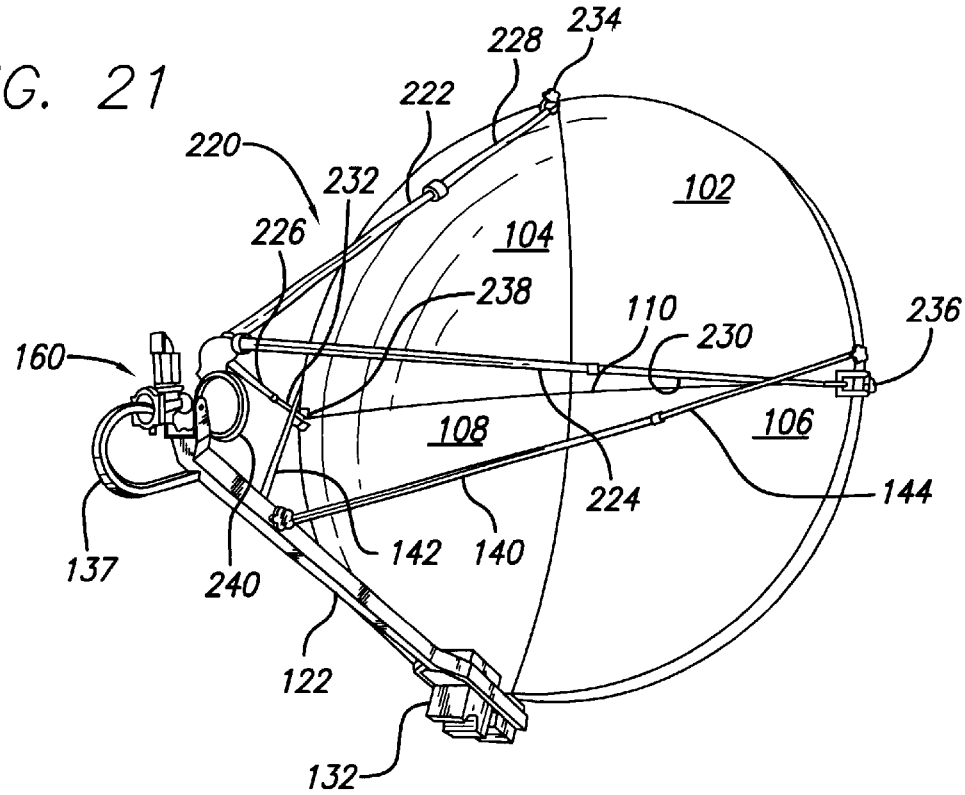
FIG. 21 illustrates a perspective view of a preferred embodiment alignment jig of the present invention that includes multiple jig arms that clamp to the antenna dish, and a suspended calibrated reference ring for positioning the horn assembly (horn assembly not shown) with respect to the antenna dish.
Figure 21A:
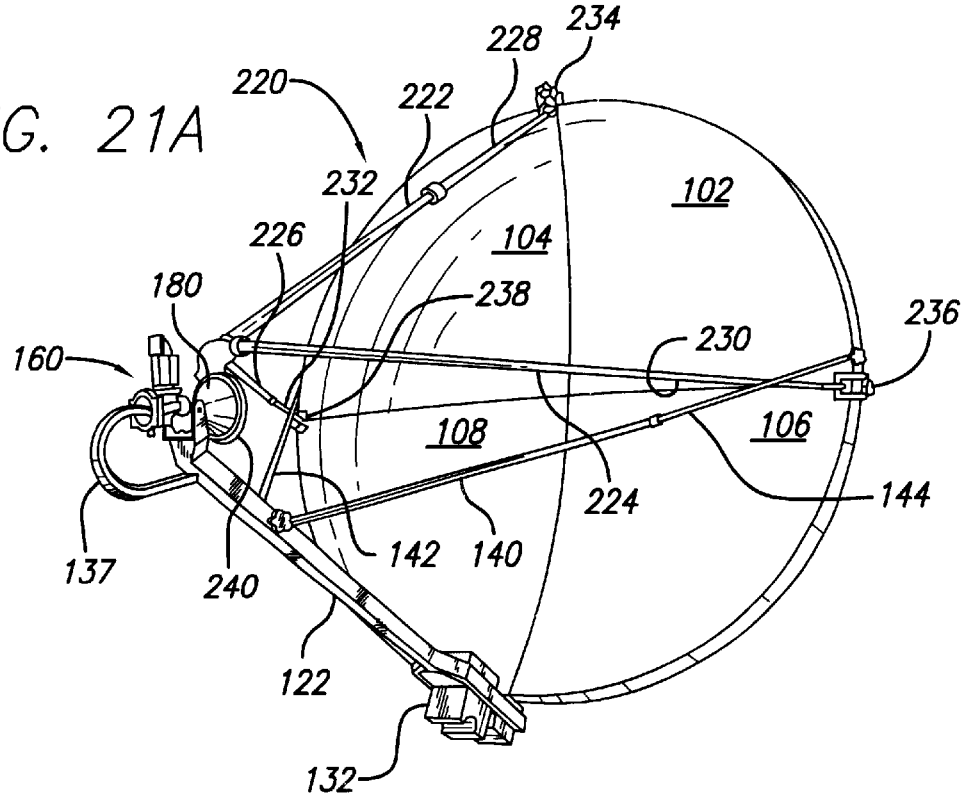
FIG. 21A illustrates a perspective view of a preferred embodiment alignment jig of the present invention that includes multiple jig arms that clamp to the antenna dish, and a suspended calibrated reference ring for positioning the horn assembly with respect to the antenna dish.
Figure 22:
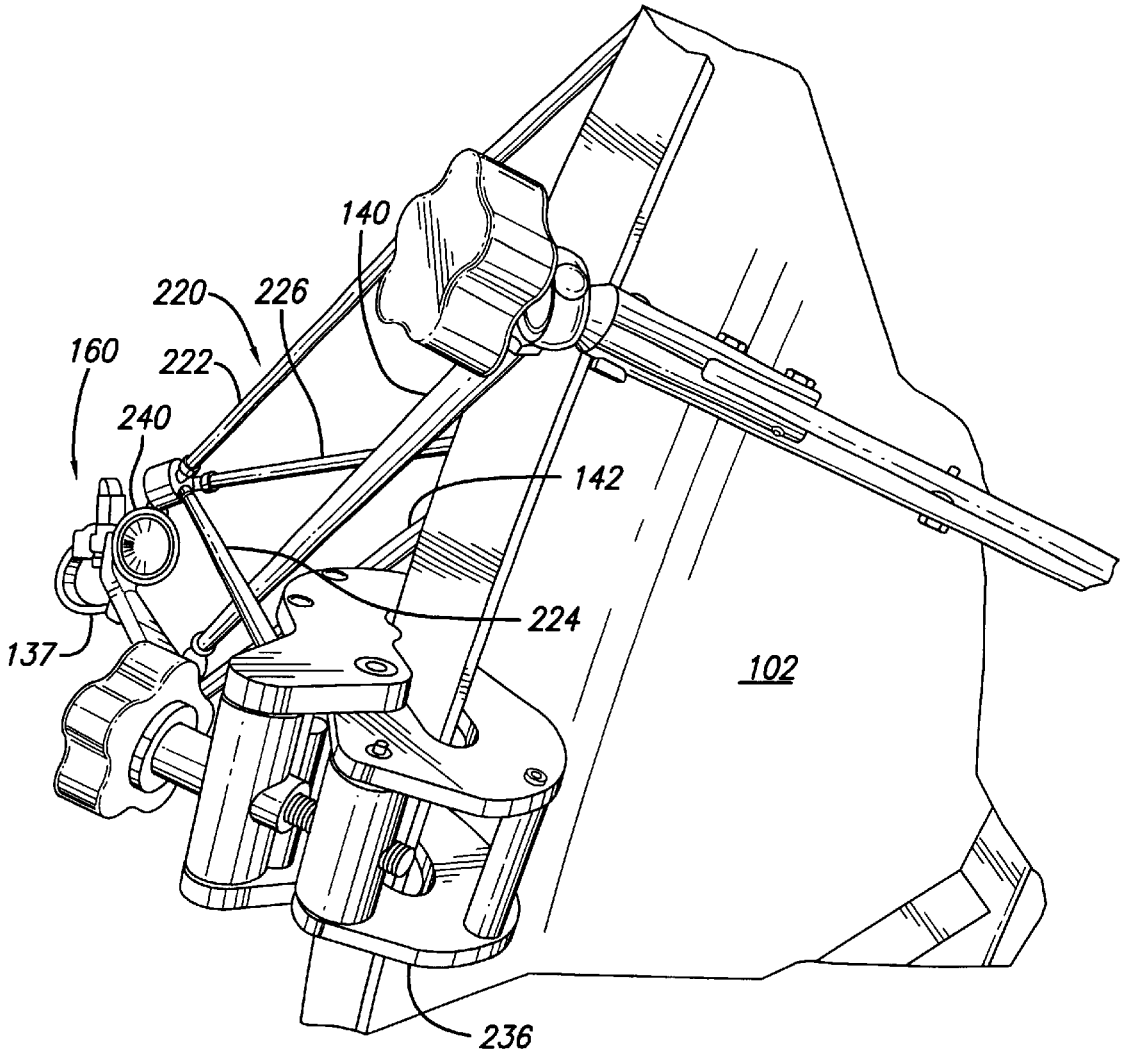
FIG. 22 illustrates a reverse partial perspective view of the alignment jig of FIG. 21 that shows a jig arm clamped to the antenna dish, as well as showing a side feed leg attached to the back frame assembly.
Figure 23:
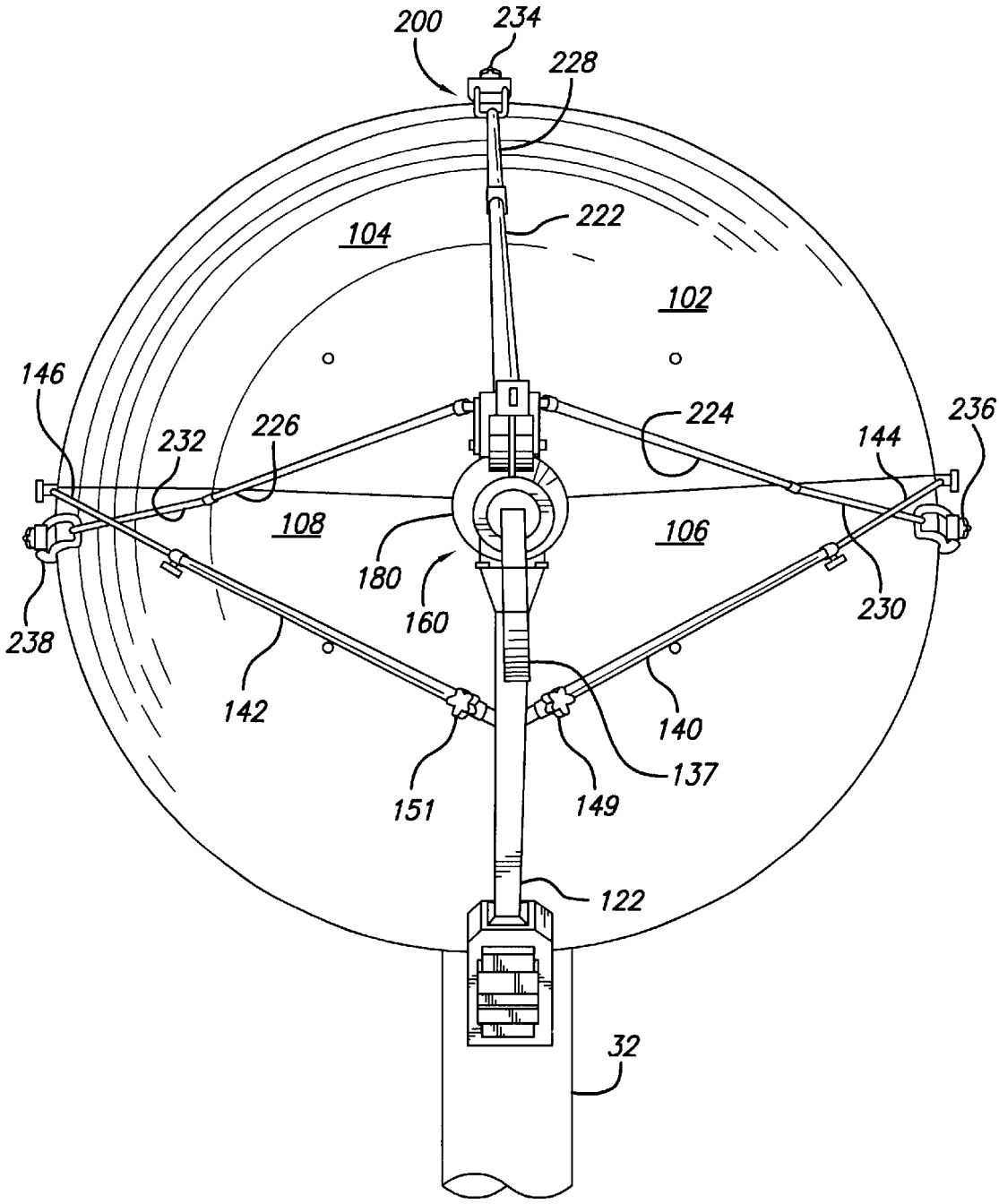
FIG. 23 illustrates a front view of the alignment jig of FIG. 21 that shows the multiple jig arms and calibrated reference ring, positioning the horn assembly with respect to the antenna dish.

Referring now to FIGS. 21–23, a preferred embodiment alignment jig 220, constructed in accordance with the present invention, is a tool that aids in the positioning of the horn assembly 180. The alignment jig 220 is particularly useful for both first time assembly and repairs of the antenna assembly 10. The alignment jig 220 includes an upper jig arm 222, a right side jig arm 224, and a left side jig arm 226, which are positioned at the top, right side, and left side of the dish assembly 100, respectively. The upper jig arm 222, right jig arm 224, and left side jig arm 226 each contain a telescoping jig arm 228, 230, and 232. These telescoping jig arms 228, 230, and 232 of the alignment jig 220 dramatically decrease the unexpanded size of the alignment jig 220, thereby dramatically increasing the portability and convenience of the alignment jig. The ends of the upper, right, and left telescoping jig arms 228, 230, and 232 attach to the dish assembly 100 through the use of simple screw clamps 234, 236, and 238. Other preferred embodiments of the present invention can also use other securing techniques to attach the telescoping jig arms 228, 230, and 232 to the dish assembly 100.

The final component of a preferred embodiment alignment jig 220 is a calibrated reference ring 240 which is suspended from the intersecting point of the upper jig arm 222, right side jig arm 224, and left side jig arm 226. The calibrated reference ring 240 is positioned and oriented so that it correspondingly mates with the dish facing portion of the horn assembly 180 when the horn assembly has been properly positioned and oriented. Otherwise stated, the horn assembly 180 should be flush and aligned with the calibrated reference ring 240 of the alignment jig 220 when the horn assembly 180 has been placed in proper alignment with the dish assembly 100.

Thus, the calibrated reference ring 240 of the alignment jig 220 designates the desired final position of the horn assembly 180. The horn mount assembly 160 and the feed leg assembly 120 are adjusted until the horn mount assembly 180 is brought into proper alignment. This device greatly simplifies the procedure of aligning the horn assembly 180 with the dish assembly 100, which is usually a complicated and time-consuming task. Additionally, the alignment jig 220 can be used to adjust the horn mount assembly 160 and feed leg assembly 120 during a first time installation, thereby increasing the speed of deployment of the antenna assembly 10 in the field, since the above described alignments and modifications have already been performed. While an alignment jig 220, constructed in accordance with the present invention, provides numerous advantages in aligning a horn assembly 180 and dish assembly 100, the alignment jig 220 is equally useful in other non-antenna systems whenever accurate alignment and orientation between two, spaced-apart components is required. Those skilled in the art will appreciate that the alignment jig 220 described above can be used either in conjunction with or independently of the other components of the antenna assembly 10 described herein.

Figure 24:
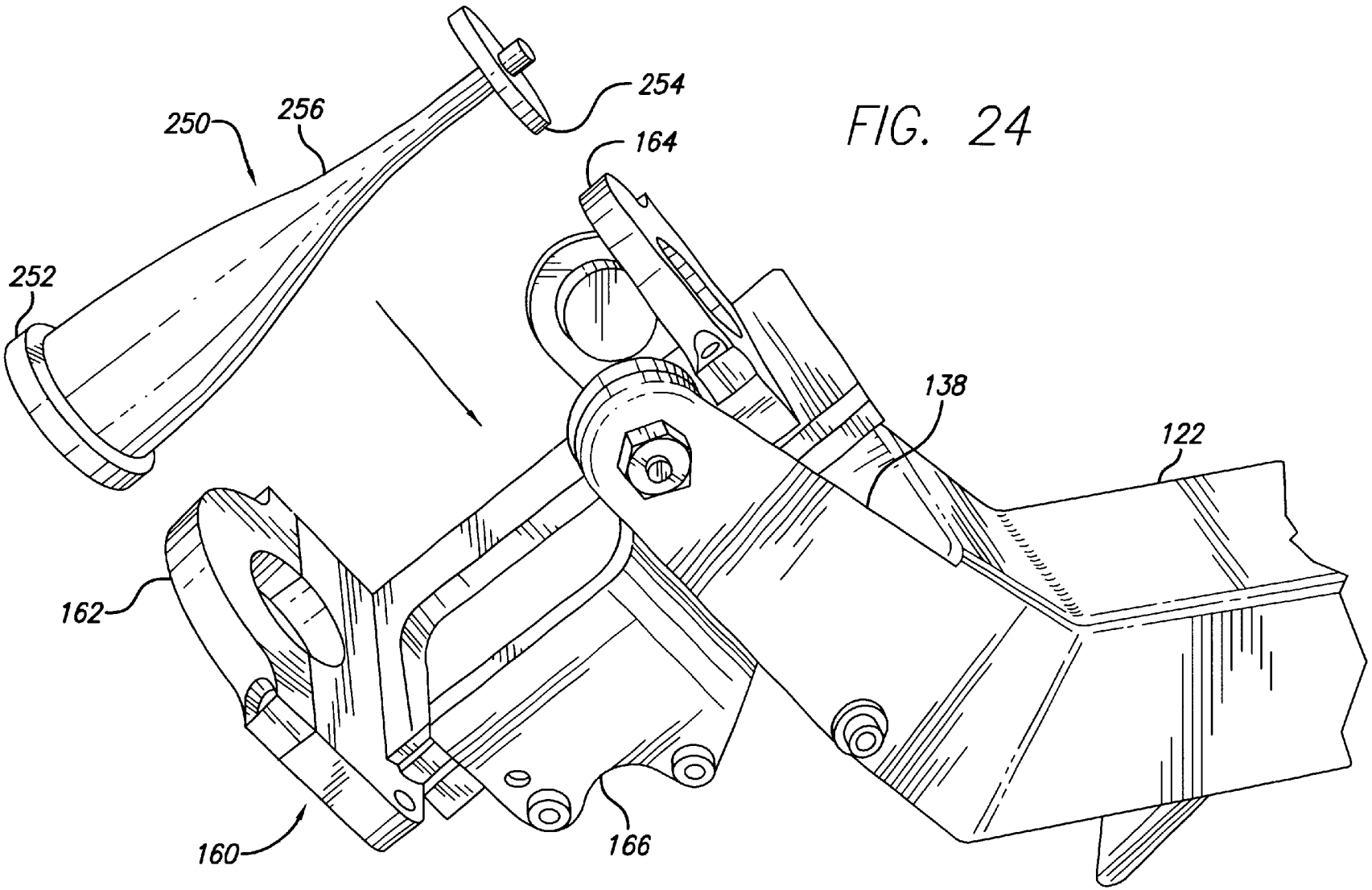
FIG. 24 illustrates an exploded view of a preferred embodiment laser alignment device of the present invention exploded out from the horn mount assembly for positioning the feed leg assembly and horn mount assembly without the antenna system actively transmitting.
Figure 25:
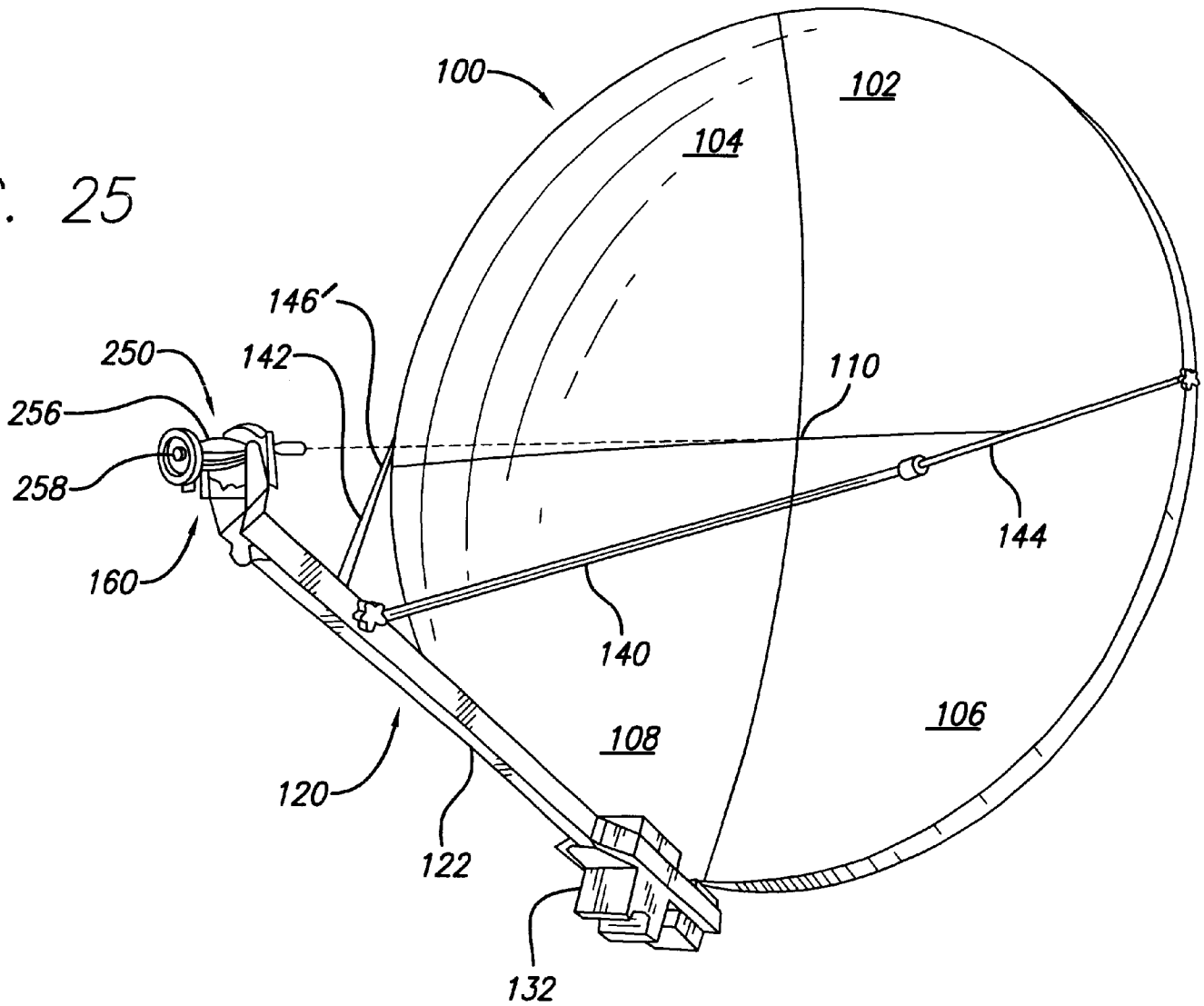
FIG. 25 illustrates a perspective view of the laser alignment device of FIG. 24 mounted within the horn mount assembly and emitting a laser towards the centerpoint of illumination of the antenna dish for aligning the horn mount assembly with respect to the antenna dish.

Referring now to FIGS. 24–25, there is shown one preferred embodiment of the present invention, having a laser alignment device 250 which is utilized to facilitate aligning the horn mount assembly 160 with the dish assembly 100. Preferably, the laser alignment device 250 includes an alignment wave guide mount 252, an alignment horn end mount 254, and an elongated shaft 256 extending there between. In one preferred embodiment, the outer diameter of the alignment wave guide mount 252 is designed to correspondingly mate with the inner diameter of the wave guide mount circular clamp 162. Similarly, the outer diameter of the alignment horn end mount 254 of the laser alignment device 250 is configured to correspondingly mate with the inner diameter of the horn circular clamp 164 of the horn mount assembly 160. In this manner, the laser alignment device 250 mounts within the horn mount assembly 160 through simple insertion, and without the need of any additional tooling, such as brackets, screws, or the like.

When the power switch 258 is activated, a laser beam is emitted from the end of the alignment device 250 and is projected towards the dish assembly 100. The jack screw 170 on the horn mount assembly 160 can then be adjusted to bring the laser beam from the alignment device 250 in precise alignment with the centerpoint of illumination 110 of the dish assembly 100. Thus, the laser alignment device 250 allows the horn assembly 180 to be aligned with the centerpoint of illumination 110 of the dish assembly 100 without the need for the antenna assembly 10 to be actively transmitting. In another preferred embodiment of the present invention, the laser alignment device 250 further includes a mock horn disc. The mock horn disc is comprised of a circular plate that corresponds dimensionally to the end of the horn assembly in both size and position when the laser sighting device is mounted on the horn mount assembly. This allows the laser alignment device 250 to be used while the alignment jig 220 is being used, thereby allowing to separate alignment actions to be performed simultaneously.

In yet other preferred embodiments of the present invention, the laser alignment device 250 utilizes alternate attachment mechanisms for connecting to the horn mount assembly 160. In still other preferred embodiments of the present invention, the laser alignment device 250 attaches directly to the horn assembly 180, instead of to the horn mount assembly 160. Those skilled in the art will appreciate that the laser alignment device 250 described above can be used either in conjunction with or independently of the other components of the antenna assembly 10 as described herein.

As shown in FIG. 7, in a preferred embodiment of the present invention, a transmission field sighting device 260 is used to assist in proper positioning of the dish assembly 100. In antenna systems that utilize an offset dish configuration (such as in the preferred embodiment of the present invention as described above), the transmission angle and, hence, the boundaries of the transmission beam, are not readily apparent from a general visual inspection. As a result, it can be difficult to determine whether or not the dish assembly 100 of the antenna assembly 10 is positioned so as to avoid obstacles within the path of the transmission beam. The transmission field sighting device 260 of the present invention is used to confirm that the dish assembly's 100 orientation has been selected such that it maintains a clear path for the transmission field.

A preferred embodiment transmission field sighting device 260, constructed in accordance with the present invention, includes a tube 262, and an attachment bracket 266. In another embodiment of the transmission's field sighting device, the device is a low power telescope with a crosshair reticule. The bracket 266 of the transmission field sighting device 260 preferably attaches to one of the side dish-engaging leaves 64 or 68 of the template assembly 61. In this manner, the sighting device 260 is aligned with the transmission axis of the dish. Thus, by simply looking through the tube 262 of the sighting device 260, a dish operator can easily spot trees, mountains, or other obstacles, and make a determination as to whether the antenna assembly 10 has sufficient clearance in its current location and orientation. While the transmission field sighting device 260 has been described herein as a detachable sighting assistance tool, in other embodiments of the present invention, the transmission field sighting device 260 may be incorporated into another component of the antenna assembly 10, such as a side feed leg 140 or 142, a side jig arm 224 or 226, or the dish assembly 100 itself. Those skilled in the art will appreciate that the transmission field sighting device 260 described above can be used either in conjunction with or independently of the other components of the antenna assembly 10 as described herein.

A preferred embodiment antenna assembly 10 has been described above in conjunction with many different component parts and related devices. A preferred embodiment of the present invention overcomes many of the drawbacks of antenna systems in the prior art. In this regard, the antenna assembly 10 of the present invention is rapidly deployable, easy to assemble, and highly modular. Further, a preferred embodiment antenna assembly 10 greatly reduces the number of parts which may be lost and eliminates the need for virtually all assembly tools. The antenna assembly 10 can be deployed and installed by a single individual and is extremely flexible in its adjustment capabilities. This is partially because the antenna assembly 10 contains parts that are easily interchangeable for specific functionality requirements. Moreover, the antenna assembly 10 of the present invention is highly accurate and extremely inexpensive in relation to the level of accuracy and amount of features that the antenna assembly 10 provides.

Throughout the above-described components, a simply implemented, yet sophisticated, assembly technique is utilized in which components are hung on initial mounting points so that the weight of the various components can be supported while fine tuning, aligning, and positioning of those components is performed. This all occurs before these components are actually locked into a secured position. This assembly technique greatly aids in assembly and allows a single individual to align and secure components that would otherwise be unwieldy due to their weight.

Moreover, those skilled in the art will recognize that although many components have been discussed above (including a pod mount assembly 20, a controller assembly 40, a back frame 60, a dish assembly 100, a feed leg assembly 120, a horn mount assembly 160, a horn assembly

180, a polarization drive assembly 190, a quick disconnect assembly 200, an alignment jig 220, a laser alignment device 250, and a transmission field sighting device 260) with respect to an overall antenna assembly 10, each of the above-discussed components can be utilized independently of the remaining components, both in the field of antenna systems, as well as in other areas of technology. Further, smaller sub-groups of the above-described components can also be utilized in conjunction with one another to provide unique utility in a wide variety of applications both inside and outside the field of antenna systems.

Furthermore, the various methodologies described above are provided by way of illustration only and should not be construed to limit the invention. Those skilled in the art will readily recognize various modifications and changes may be made to the present invention without departing from the true spirit and scope of the present invention. Accordingly, it is not intended that the invention be limited, except as by the appended claims.

What is claimed is:

1. A quick disconnect assembly for precise connection and disconnection of components, the quick disconnect assembly comprising:

a first component having a first fitting and a second component having a second fitting, wherein the first fitting is configured to seat against the second fitting;

a receiver secured to the first fitting, wherein the receiver is configured to correspondingly house the second fitting upon selective insertion of the second fitting into the receiver, wherein the receiver includes a contact face, a fork end brace, and a threaded aperture;

a fork having a contact face, a base portion, and two legs with leg ends, the base portion including a securement knob with threadings, wherein rotation of the securement knob advances or retracts the threadings;

whereby insertion of the ends of the legs under the fork end brace of the receiver and rotation of the fork legs about the fork end brace causes the contact face of the fork to seat against the contact face of the receiver, and whereby tightening of the securement knob causes the threadings of the fork to secure into the threaded aperture of the receiver, thereby securing the fork against the receiver.

2. The quick disconnect assembly of claim 1, wherein the legs of the fork are shaped and sized to seat over the second component.

3. The quick disconnect assembly of claim 1, wherein securing the fork to the receiver affixes the second fitting against the first fitting and within the receiver.

4. The quick disconnect assembly of claim 1, wherein the receiver includes a plurality of depressions, and the fork legs include a plurality of protrusions that are positioned and configured to correspondingly mate with the depressions in the receiver, and wherein insertion of the ends of the legs under the fork end brace of the receiver and rotation of the fork legs about the fork end brace causes the protrusions on the fork legs to seat into the depressions within the receiver when the fork is secured against the receiver.

5. The quick disconnect assembly of claim 1, wherein securing the fork against the receiver creates substantially evenly distributed pressure between the first fitting and the second fitting.

6. The quick disconnect assembly of claim 1, wherein the receiver includes a plurality of protrusions, and the fork legs include a plurality of depressions that are positioned and configured to correspondingly mate with the protrusions on the receiver, and wherein insertion of the ends of the legs under the fork end brace of the receiver and rotation of the fork legs about the fork end brace causes the depressions in the fork legs to seat onto the protrusions on the receiver when the fork is secured against the receiver.

7. The quick disconnect assembly of claim 1, wherein the threadings penetrate through the base portion of the fork.

8. The quick disconnect assembly of claim 1, wherein the quick disconnect assembly secures the first component to the second component without the use of loose parts or tools.

9. The quick disconnect assembly of claim 1, wherein the fork is operatively connected to the second component.

10. The quick disconnect assembly of claim 1, wherein the first component comprises an amplifier, the first fitting comprises a mating wave guide fitting, the second component comprises a wave guide, and the second fitting comprises a wave guide end fitting, whereby the quick disconnect assembly is used to secure the wave guide to the amplifier in an antenna system.

11. A quick disconnect assembly for precise connection and disconnection of components, the quick disconnect assembly comprising:

a wave guide having a wave guide end fitting and an amplifier having a mating wave guide fitting, wherein the wave guide end fitting is configured to seat against the mating wave guide fitting;

a receiver secured to the mating wave guide fitting, wherein the receiver is configured to correspondingly house the wave guide end fitting upon selective insertion of the wave guide end fitting into the receiver, wherein the receiver includes a contact face, a fork end brace, and a threaded aperture;

a fork having a contact face, a base portion, and two legs with leg ends, the base portion including a securement knob with threadings, wherein rotation of the securement knob advances or retracts the threadings;

whereby insertion of the ends of the legs under the fork end brace of the receiver and rotation of the fork legs about the fork end brace causes the contact face of the fork to seat against the contact face of the receiver, and whereby tightening of the securement knob causes the threadings of the fork to secure into the threaded aperture of the receiver, thereby securing the fork against the receiver.

12. The quick disconnect assembly of claim 11, wherein the legs of the fork are shaped and sized to seat over the amplifier.

13. The quick disconnect assembly of claim 11, wherein securing the fork to the receiver affixes the mating wave guide fitting against the wave guide end fitting and within the receiver.

14. The quick disconnect assembly of claim 11, wherein the receiver includes a plurality of depressions, and the fork legs include a plurality of protrusions that are positioned and configured to correspondingly mate with the depressions in the receiver, and wherein insertion of the ends of the legs under the fork end brace of the receiver and rotation of the fork legs about the fork end brace causes the protrusions on the fork legs to seat into the depressions within the receiver when the fork is secured against the receiver.

15. The quick disconnect assembly of claim 11, wherein the fork creates substantially evenly distributed pressure between the wave guide end fitting and the mating wave guide fitting.

16. The quick disconnect assembly of claim 11, wherein the receiver includes a plurality of protrusions, and the fork legs include a plurality of depressions that are positioned and configured to correspondingly mate with the protrusions on the receiver, and wherein insertion of the ends of the legs under the fork end brace of the receiver and rotation of the fork legs about the fork end brace causes the depressions in the fork legs to seat onto the protrusions on the receiver when the fork is secured against the receiver.

17. The quick disconnect assembly of claim 11, wherein the threadings penetrate through the base portion of the fork.

18. The quick disconnect assembly of claim 11, wherein the quick disconnect assembly secures the wave guide to the amplifier without the use of loose parts or tools.

19. The quick disconnect assembly of claim 11, wherein the fork is operatively connected to the amplifier.

20. An antenna system including a quick disconnect assembly for precise connection and disconnection of components, the quick disconnect assembly of the antenna system comprising:

a wave guide having a wave guide end fitting and an amplifier having a mating wave guide fitting, wherein the wave guide end fitting is configured to seat against the mating wave guide fitting;

a receiver secured to the mating wave guide fitting, wherein the receiver is configured to correspondingly house the wave guide end fitting upon selective insertion of the wave guide end fitting into the receiver, wherein the receiver includes a contact face, a fork end brace, and a threaded aperture;

a fork having a contact face, a base portion, and two legs with leg ends, the base portion including a securement knob with threadings, wherein rotation of the securement knob advances or retracts the threadings;

whereby insertion of the ends of the legs under the fork end brace of the receiver and rotation of the fork legs about the fork end brace causes the contact face of the fork to seat against the contact face of the receiver, and whereby tightening of the securement knob causes the threadings of the fork to secure into the threaded aperture of the receiver, thereby securing the fork against the receiver.

* * * * *

UNITED STATES PATENT AND TRADEMARK OFFICE

CERTIFICATE OF CORRECTION

PATENT NO. : 6,462,715 B1
DATED : October 8, 2002
INVENTOR(S) : Ehrenberg et al.

It is certified that error appears in the above-identified patent and that said Letters Patent is hereby corrected as shown below:

Column 10,
Line 6, change the word “comers” to -- corners --.
Line 11, delete “-” before the word “point.”
Line 34, change the word “comer” to -- corner --.

Column 12,
Line 1, delete paragraph indent before the word “Preferably.”
Line 55, delete the hyphen before the word “handed.”
Line 64, change the word “tumbuckles” to -- turnbuckles --.

Column 13,
Line 17, delete “;” before the word “adjustable.”

Signed and Sealed this

Twenty-fifth Day of March, 2003

JAMES E. ROGAN
*Director of the United States Patent and Trademark Office*